US011751706B2

(12) United States Patent
Nishijima et al.

(10) Patent No.: US 11,751,706 B2
(45) Date of Patent: Sep. 12, 2023

(54) CONTAINER AND WITHDRAWAL SYSTEM

(71) Applicant: BRITA LP, Oakland, CA (US)

(72) Inventors: Rick T. Nishijima, Pleasanton, CA (US); Russell E. Bell, Pleasanton, CA (US)

(73) Assignee: BRITA LP, Brampton (CA)

( * ) Notice: Subject to any disclaimer, the term of this patent is extended or adjusted under 35 U.S.C. 154(b) by 305 days.

(21) Appl. No.: 16/664,440

(22) Filed: Oct. 25, 2019

(65) Prior Publication Data

US 2020/0138212 A1 May 7, 2020

Related U.S. Application Data

(60) Provisional application No. 62/756,422, filed on Nov. 6, 2018.

(51) Int. Cl.

| | |
|---|---|
| ***A47G 19/22*** | (2006.01) |
| ***A47G 21/18*** | (2006.01) |
| ***B65D 47/32*** | (2006.01) |
| ***B65D 47/20*** | (2006.01) |
| ***B65D 51/24*** | (2006.01) |

(52) U.S. Cl.

CPC ..... *A47G 19/2272* (2013.01); *A47G 21/188* (2013.01); *B65D 47/2018* (2013.01); *B65D 47/32* (2013.01); *B65D 51/242* (2013.01)

(58) Field of Classification Search

CPC .... A47G 21/188; B65D 47/32; B65D 51/242; B65D 47/2018

See application file for complete search history.

(56) References Cited

U.S. PATENT DOCUMENTS

| | | | | |
|---|---|---|---|---|
| 5,509,605 | A * | 4/1996 | Cripe | A47G 21/188 210/266 |
| 6,196,413 | B1 * | 3/2001 | Tung | B65D 47/0885 220/717 |
| 7,712,618 | B2 | 5/2010 | Bertrand et al. | |
| 8,985,370 | B2 | 3/2015 | Lane | |
| 9,045,353 | B2 | 6/2015 | Parekh et al. | |
| 9,150,335 | B2 | 10/2015 | Lane | |
| 9,380,898 | B2 * | 7/2016 | Mason | A47G 19/2272 |
| 9,650,183 | B2 | 5/2017 | Chen et al. | |
| 9,873,554 | B2 | 1/2018 | Choltco-Devlin | |
| 9,878,832 | B2 | 1/2018 | Sims | |
| 2003/0136783 | A1 * | 7/2003 | Hatsumoto | A47J 41/0027 220/254.3 |
| 2012/0312832 | A1 | 12/2012 | Lane | |
| 2013/0175270 | A1 | 7/2013 | Fujita et al. | |
| 2014/0263324 | A1 * | 9/2014 | Latham | B65D 51/18 220/259.3 |
| 2014/0339177 | A1 | 11/2014 | Lane | |
| 2015/0282654 | A1 | 10/2015 | Kurabe et al. | |
| 2016/0031721 | A1 | 2/2016 | Kellam et al. | |

(Continued)

FOREIGN PATENT DOCUMENTS

| | | | |
|---|---|---|---|
| WO | WO201753588 | A1 | 3/2017 |

*Primary Examiner* — Jeffrey R Allen

(74) *Attorney, Agent, or Firm* — Edell, Shapiro & Finnan, LLC

(57) ABSTRACT

A container system having an access portal is disclosed. The container system may contain a selected material for access and withdraw through the portal. The portal may be engaged in any appropriate manner, such as with the application of a vacuum or pouring out.

29 Claims, 15 Drawing Sheets

(56) References Cited

U.S. PATENT DOCUMENTS

| | | | |
|---|---|---|---|
| 2016/0106241 | A1 | 4/2016 | Wong |
| 2016/0318693 | A1 | 11/2016 | Hein et al. |
| 2017/0137176 | A1 | 5/2017 | Gorbold et al. |
| 2017/0253395 | A1 | 9/2017 | Matthis |
| 2017/0320640 | A1 | 11/2017 | Steinmann |

* cited by examiner

CONTAINER AND WITHDRAWAL SYSTEM

CROSS-REFERENCE

This application claims the benefit of and priority to U.S. Provisional Application No. 62/756,422, filed on Nov. 6, 2018. The disclosure is herein incorporated by reference in its entirety.

FILED

The present disclosure relates to a container system, in particularly to a container system including an elongated tube positioned in the container.

BACKGROUND

This section provides background information related to the present disclosure which is not necessarily prior art.

A container may generally be used to hold a selected material, such as a liquid, gas, or solid. In various configurations a container may be held by a person or supported by a platform for holding the selected material. The container may then be accessed to obtain the material from within the container at a selected time.

Certain containers may be used to hold or contain fluids for use by a person or community at a selected time. For example, a container may be used to hold water or other drinkable fluid for a period of time. To ensure that the container maintains the fluid within the container, the container may include a lid that is removably fixed to the container bottle, such as having a screw-on lid.

SUMMARY

This section provides a general summary of the disclosure, and is not a comprehensive disclosure of its full scope or all of its features.

A container system may contain a selected material for access at a selected time. For example, the container may include a graspable container that is sized to be held by a hand of a human. The container, however, may also be sized in any appropriate manner for selected purposes. The material within the container may be accessed by pouring material out of the container, such as a liquid. In various embodiments, however, an elongated tube may also be positioned within the container. The elongated tube may also be referred to herein as a straw. Connected to the straw may be a mouthpiece that sealingly engages the straw. A user may engage the mouthpiece with a user's mouth and lips and cause a suction within the mouthpiece to form a vacuum within the mouthpiece and, therefore, a vacuum within the straw to draw liquid through the straw and out the mouthpiece.

Positioned within the straw may be one or more materials, such as a filter that allows for filtering the fluid within the container. The filter may be formed of a selected material, such as a block carbon, textile material, textile impregnated with a selected material (e.g. activated carbon), or other appropriate materials.

The container may further include a lid that engages the mouthpiece to seal the container when not being used to withdraw fluid from the container. The lid has a surface to engage the mouthpiece to seal the mouthpiece and, therefore, the interior of the container from an exterior of the container. The lid may further include additional sealing members or features to seal the container, such as seal a vent hole within the container. Further the lid may be movably positioned relative to the container to allow a user to position the lid for use of the mouthpiece, such as withdrawing a liquid from the container.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 1:
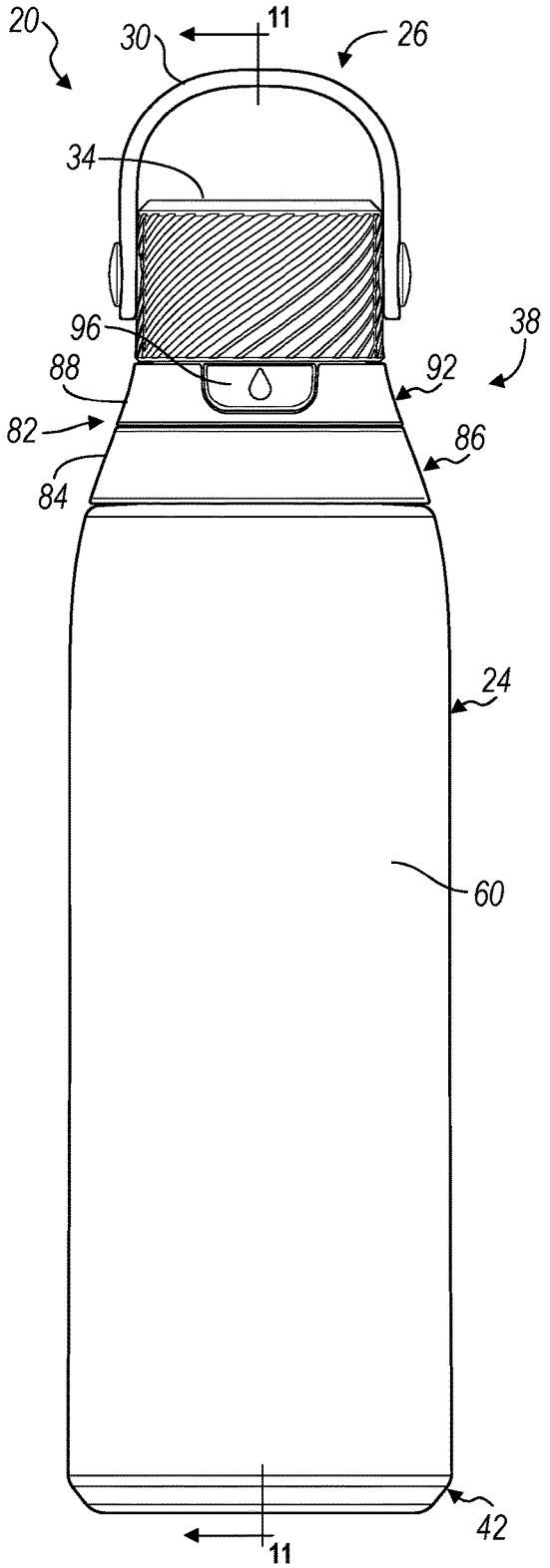
FIG. 1 is a front elevation view of a container and lid assembly, according to various embodiments.
Figure 2:
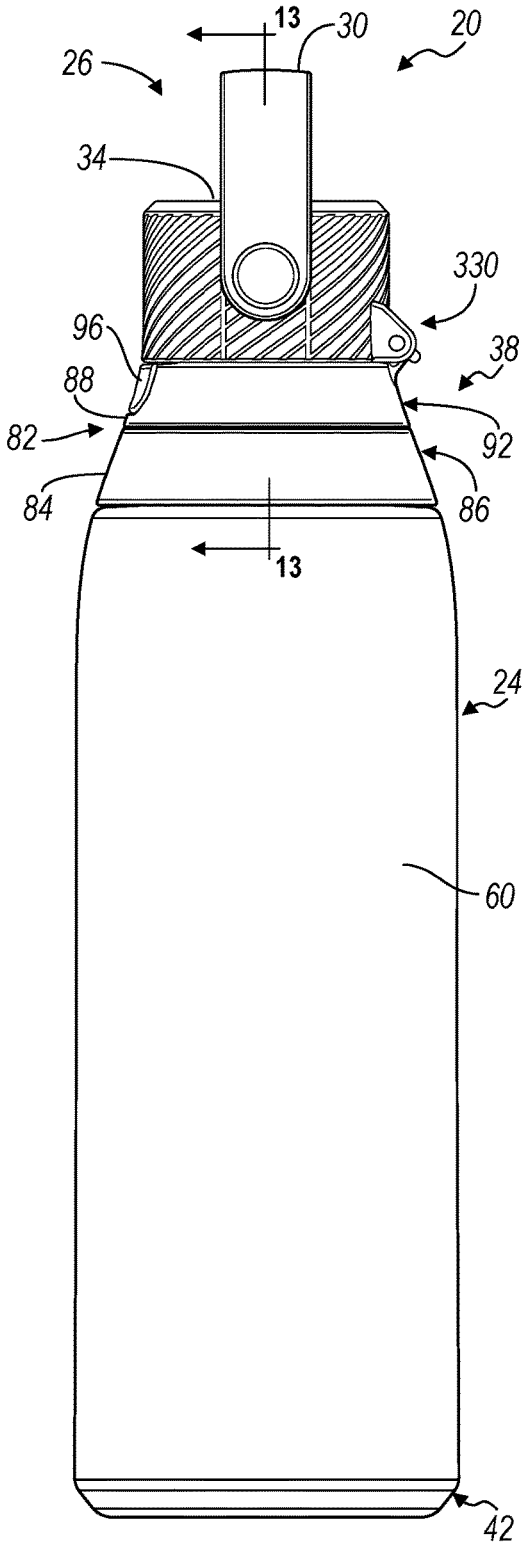
FIG. 2 is a right side elevation view of the container of FIG. 1.
Figure 3:
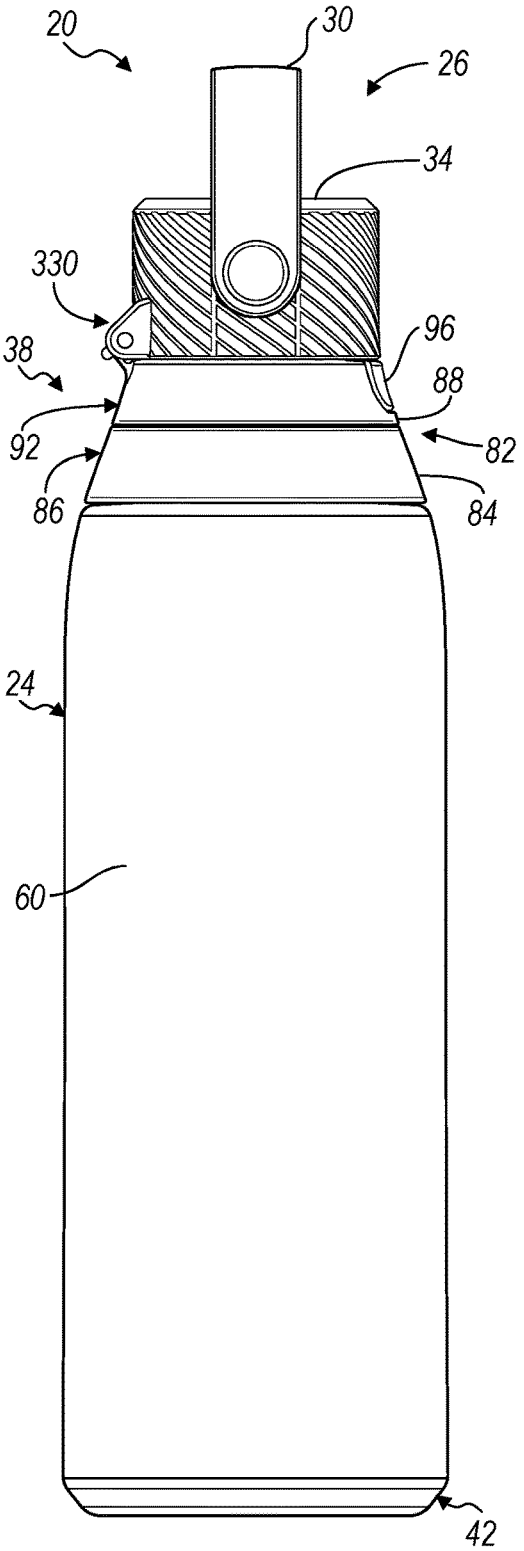
FIG. 3 is a left side elevation view of the container of FIG. 1.
Figure 4:
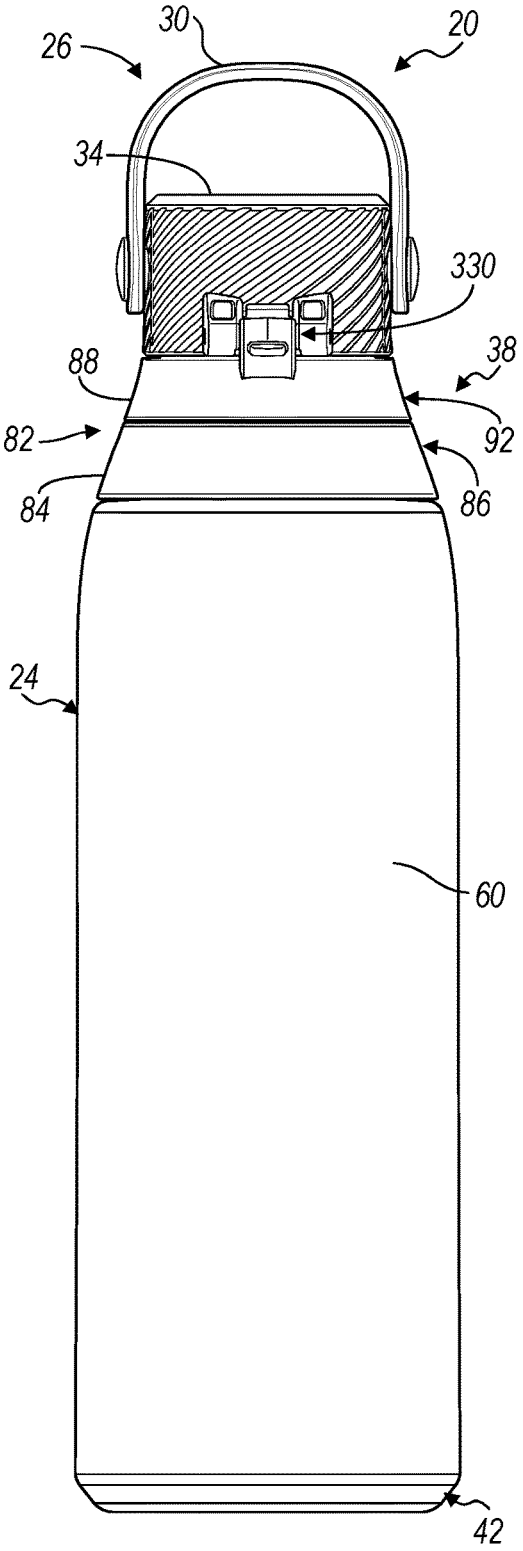
FIG. 4 is a back elevation view of the container of FIG. 1.
Figure 5:
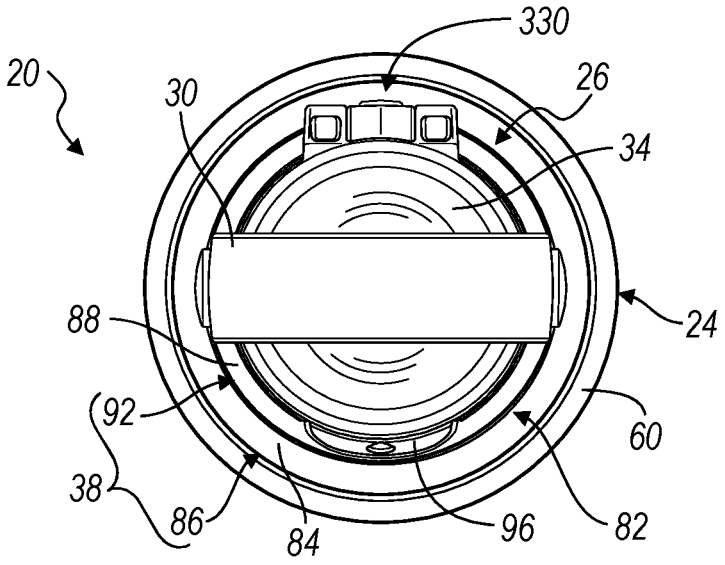
FIG. 5 is a top plan view of the container of FIG. 1.
Figure 6:
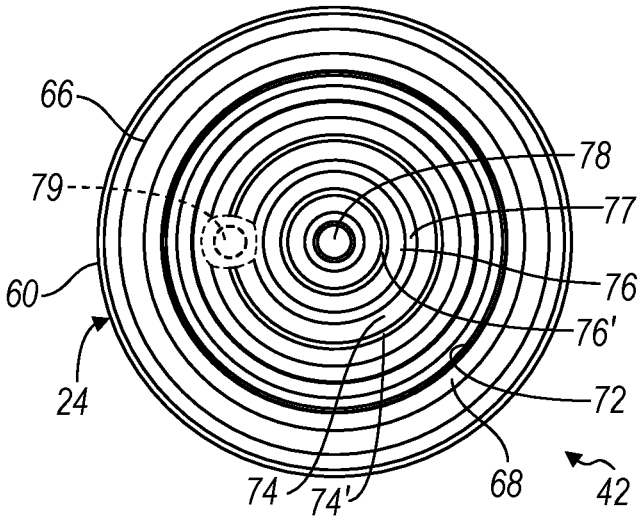
FIG. 6 is a bottom plan view of the container of FIG. 1.
Figure 7:
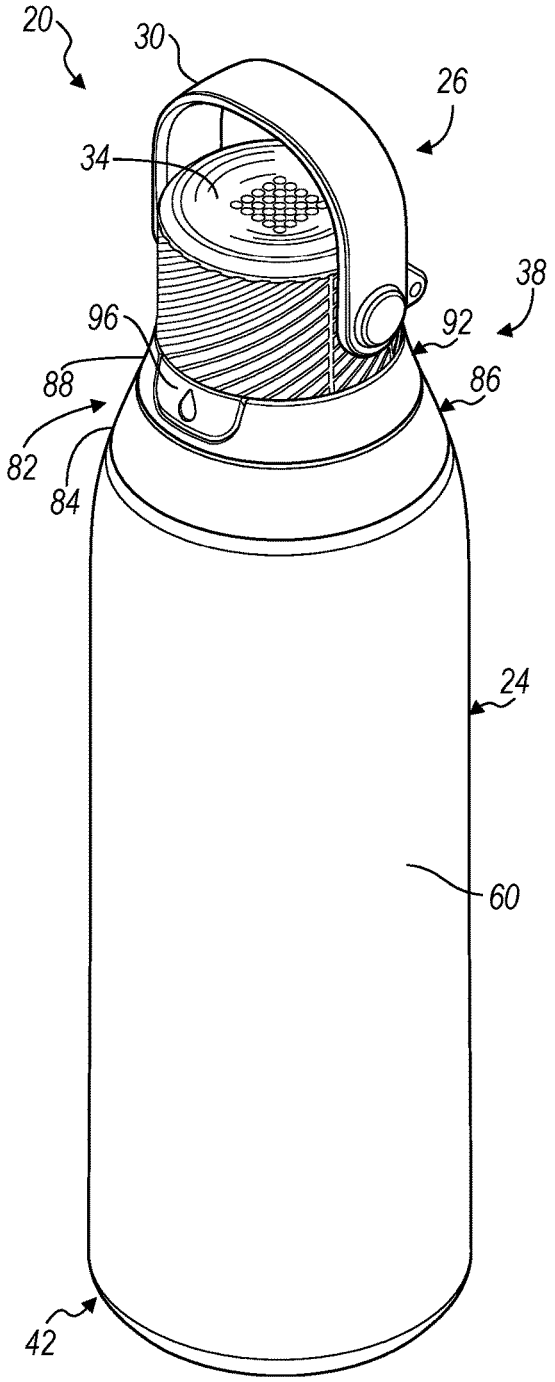
FIG. 7 is a top perspective view of the container of FIG. 1.
Figure 9:
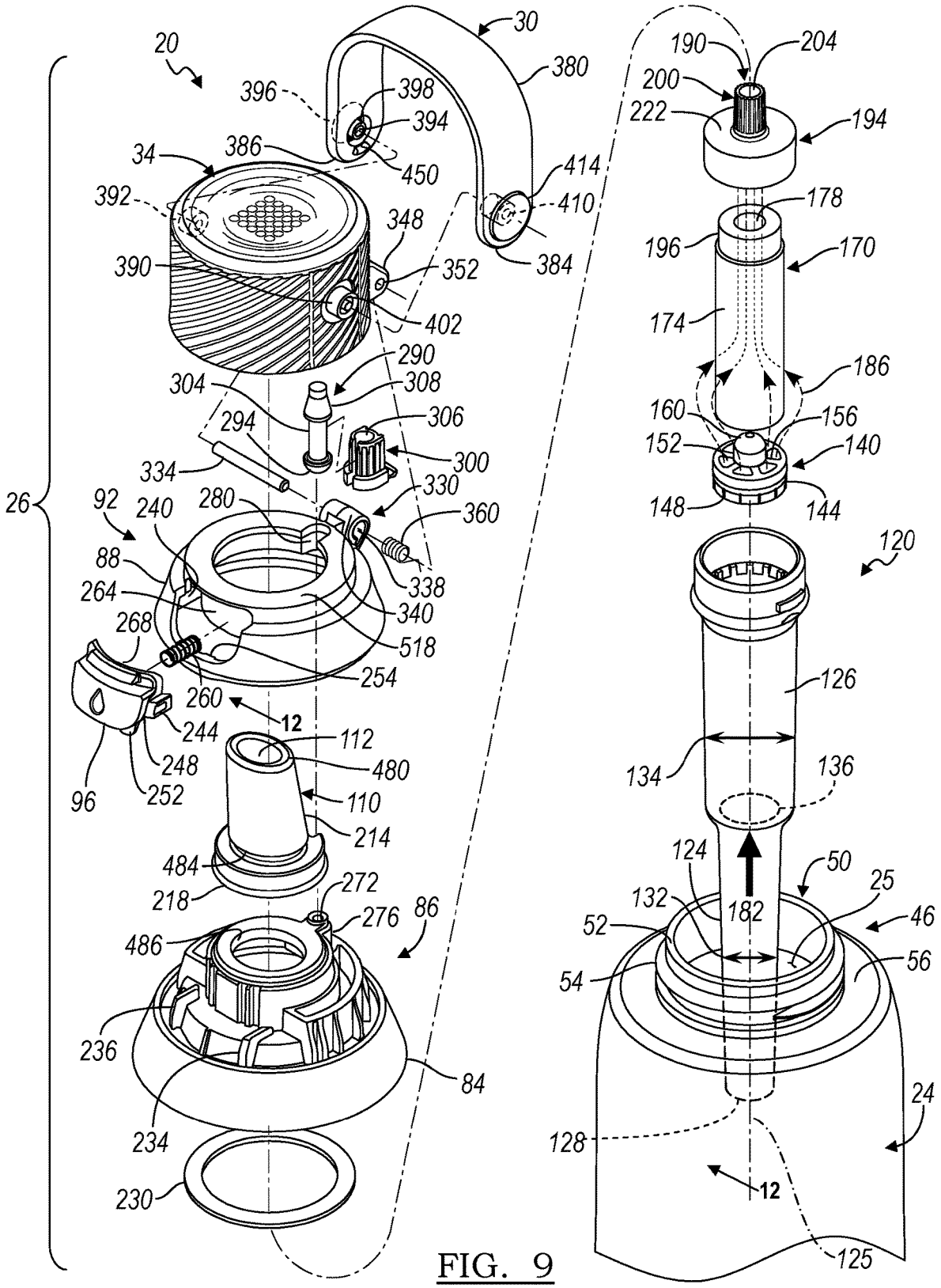
FIG. 9 is an exploded perspective view of the container of FIG. 1.
Figure 11A:
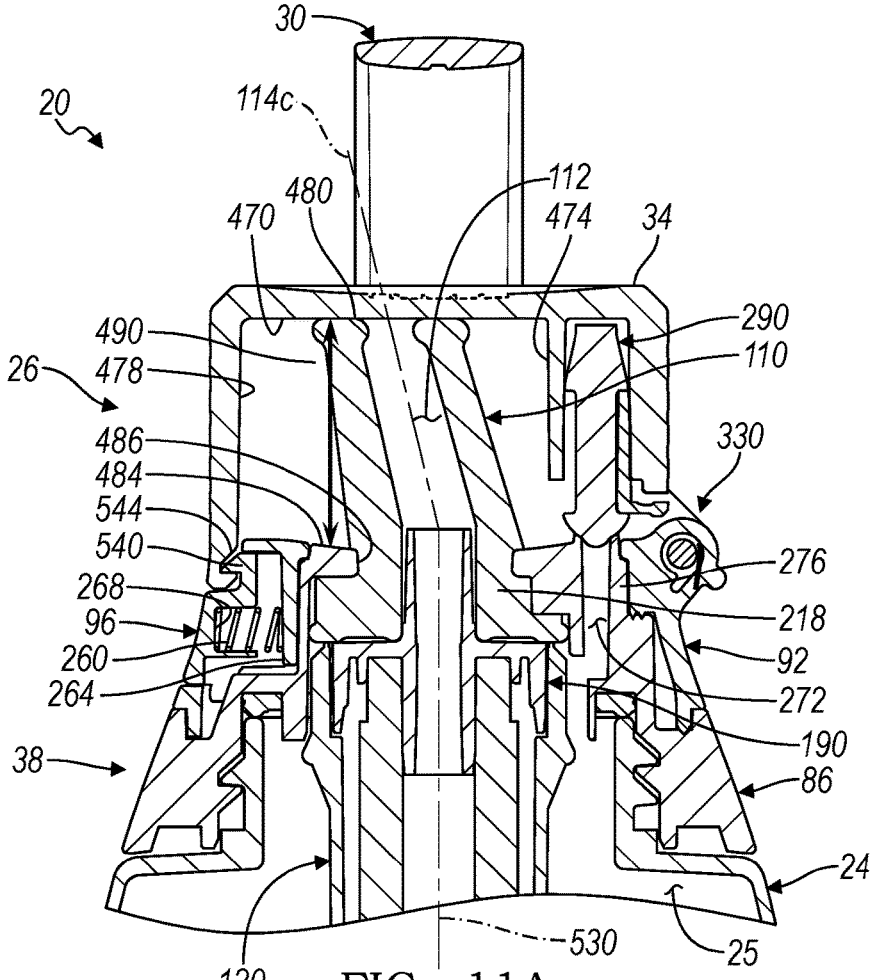
FIG. 11A is a detailed cross-sectional view of the cap of the container in a closed first position taken along line 11-11 in FIG. 1.
Figure 11A:
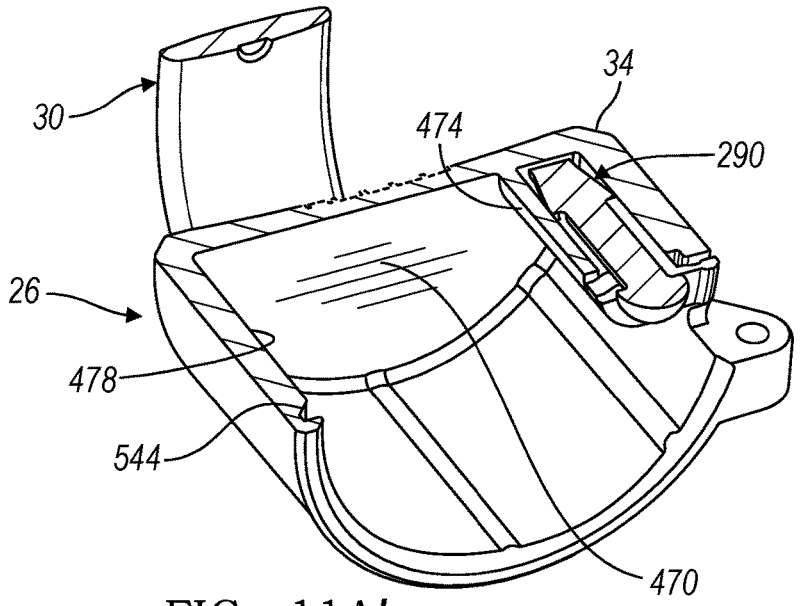
Figure 11B:
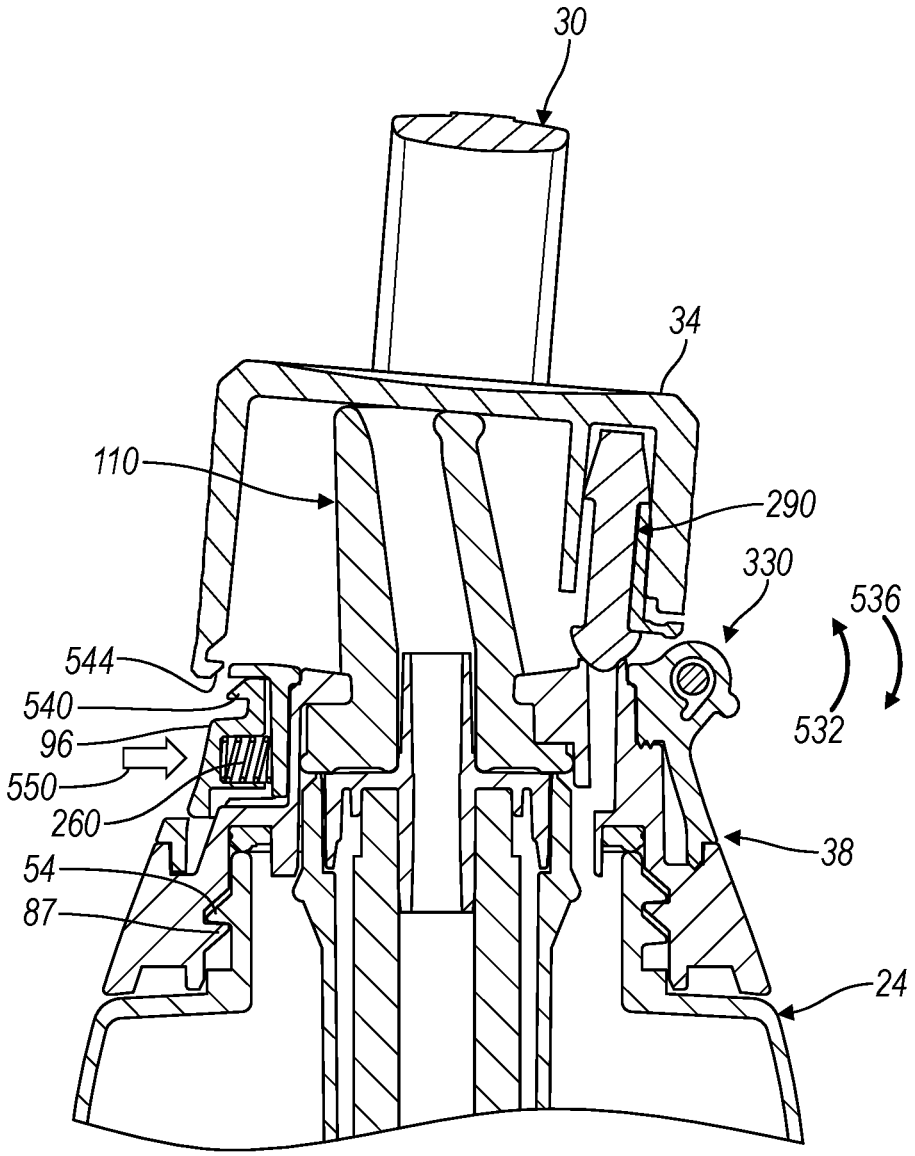
Figure 11C:
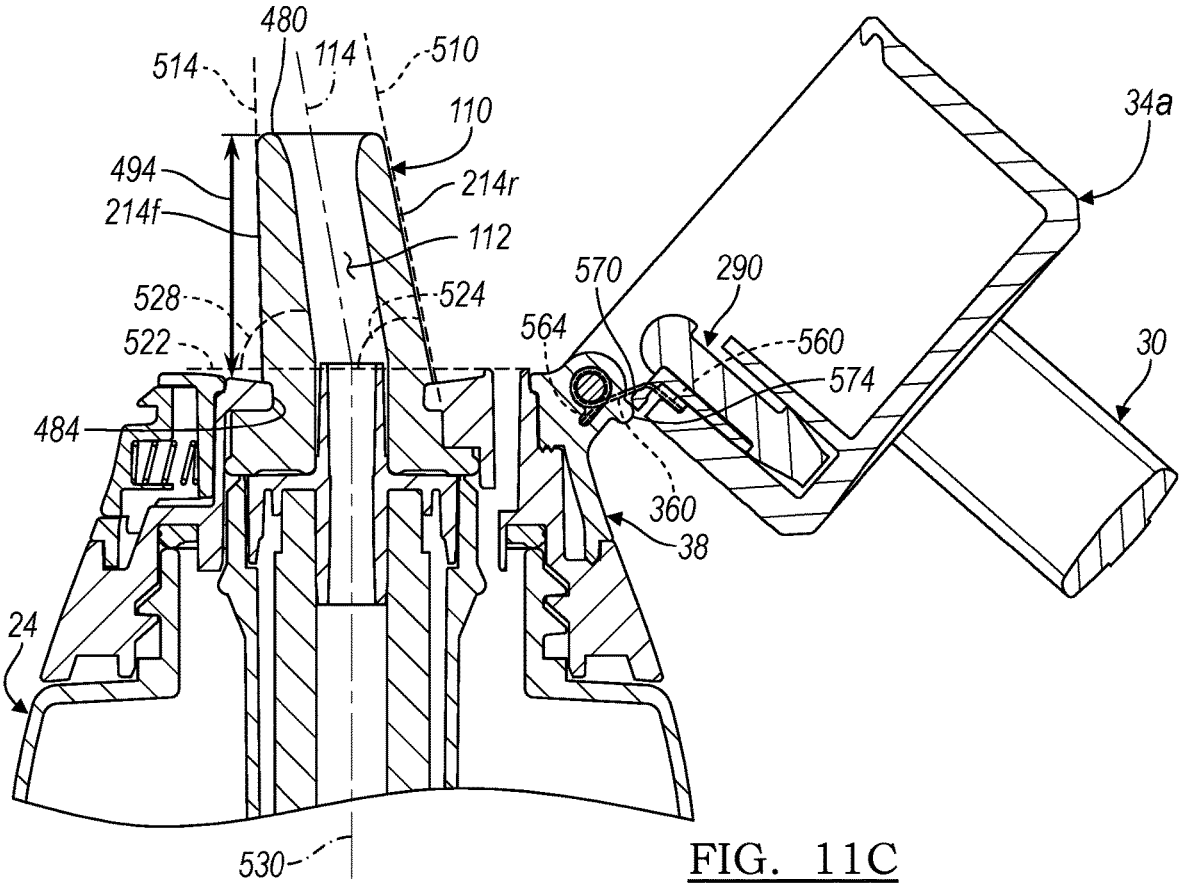
Figure 11C:
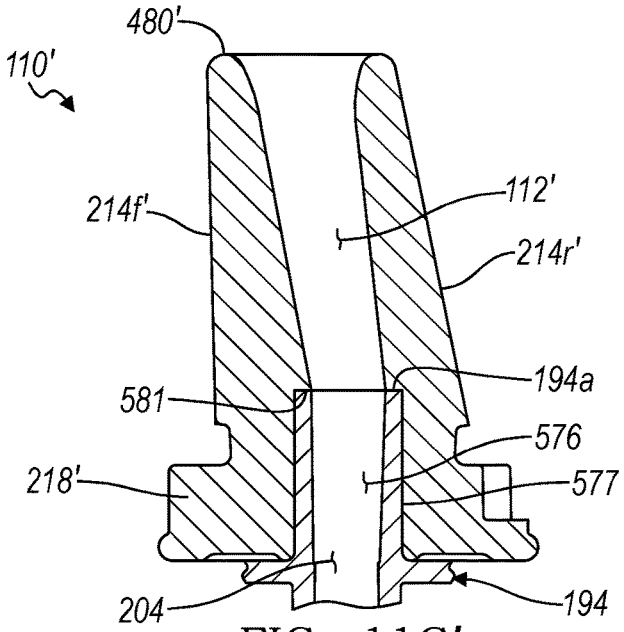
Figure 11D:
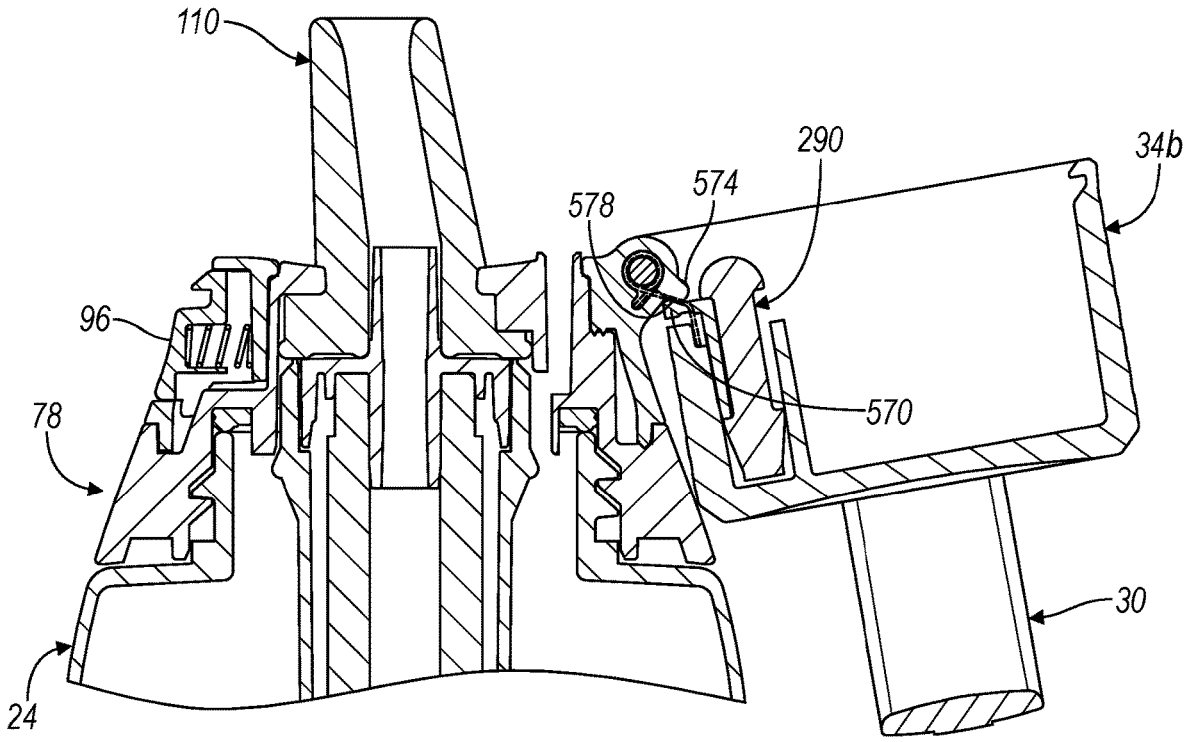
Figure 12A:
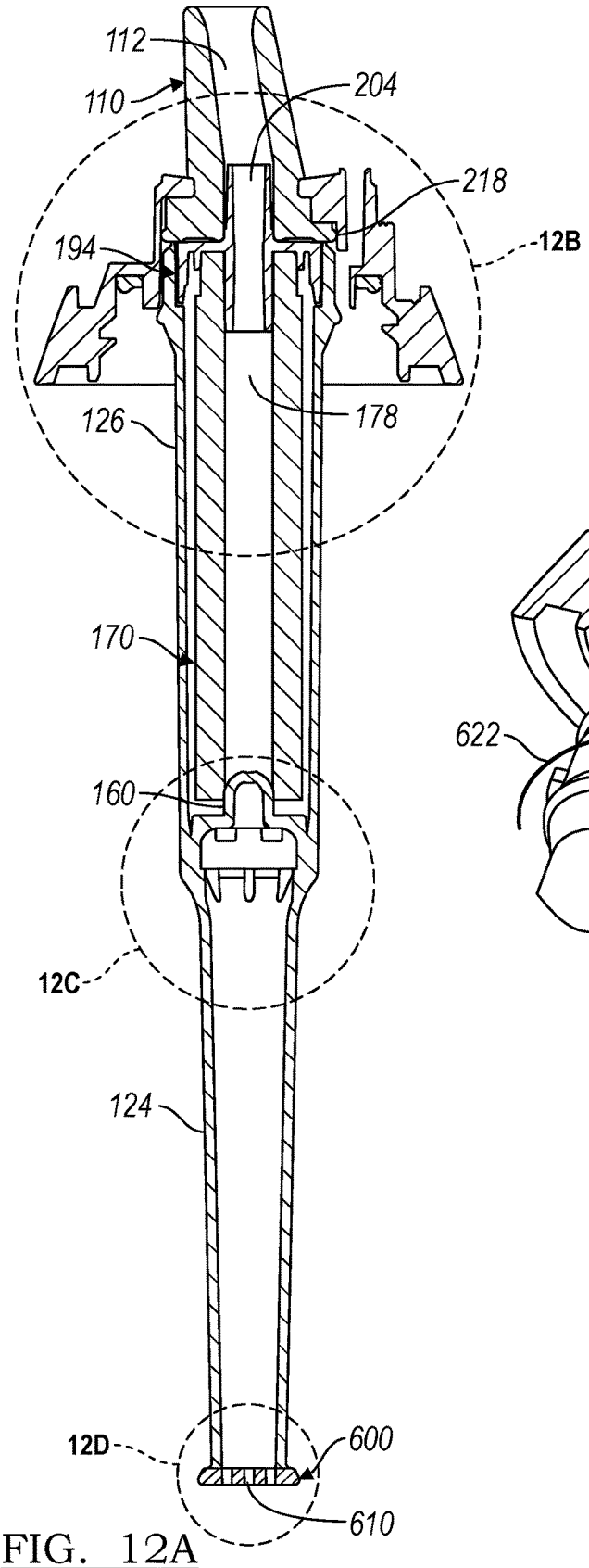
Figure 12B:
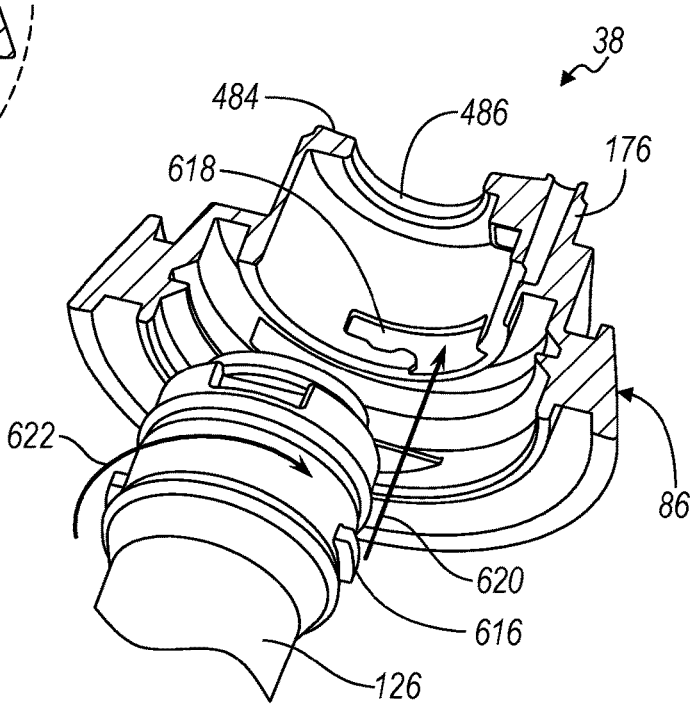
Figure 12C:
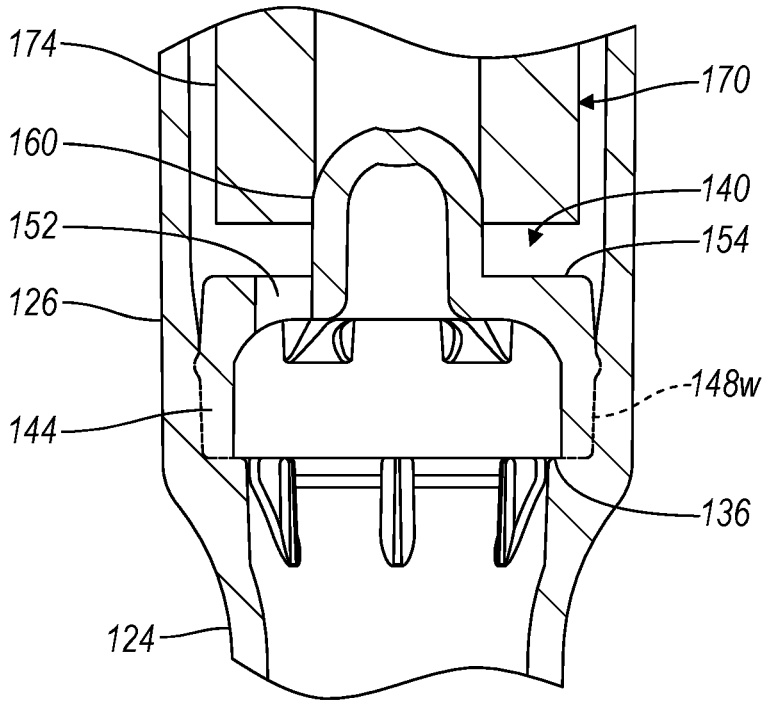
Figure 12D:
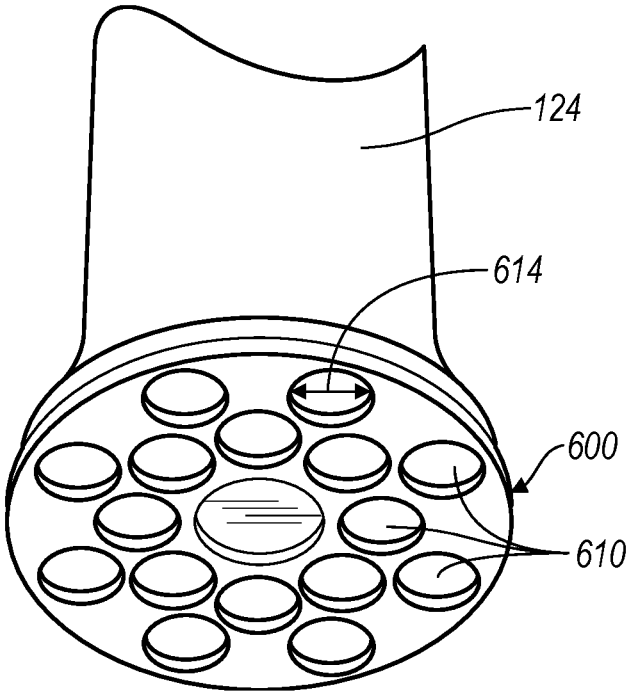
Figure 13A:
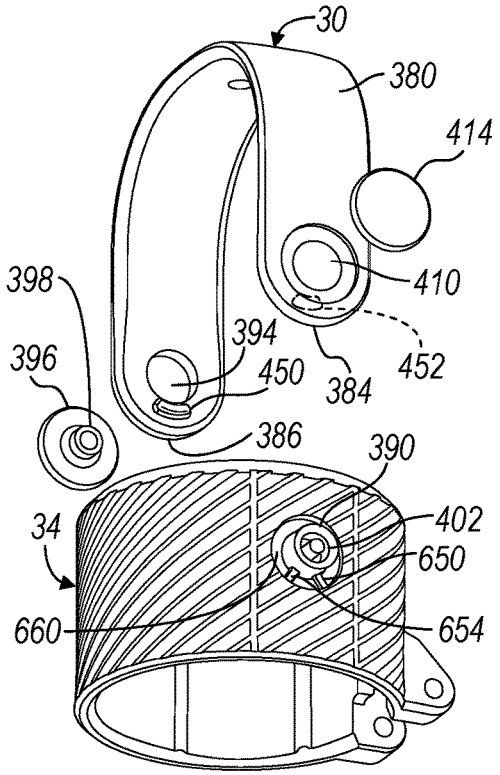
Figure 13B:
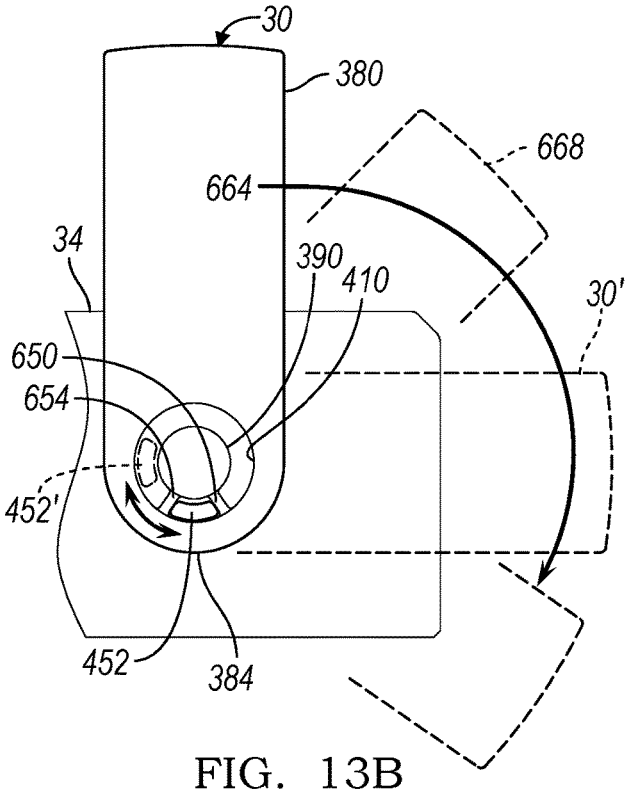
Figure 13C:
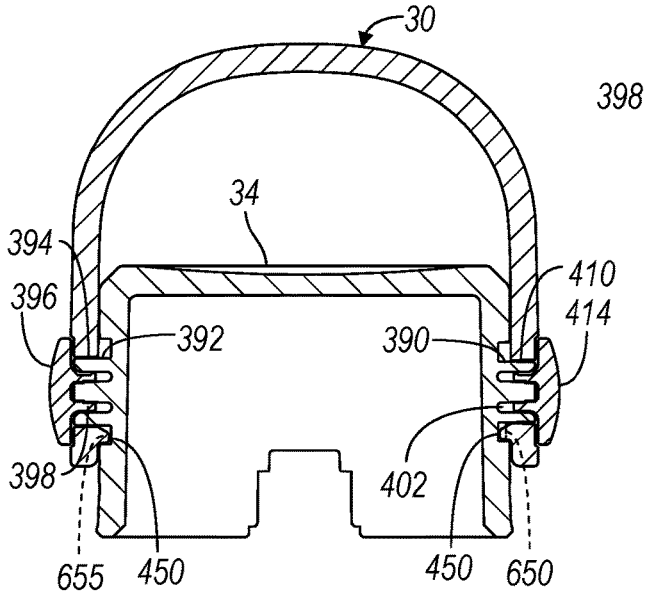
Figure 13D:
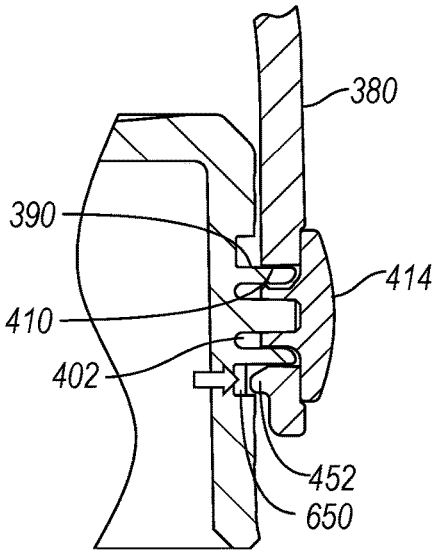
Figure 14:
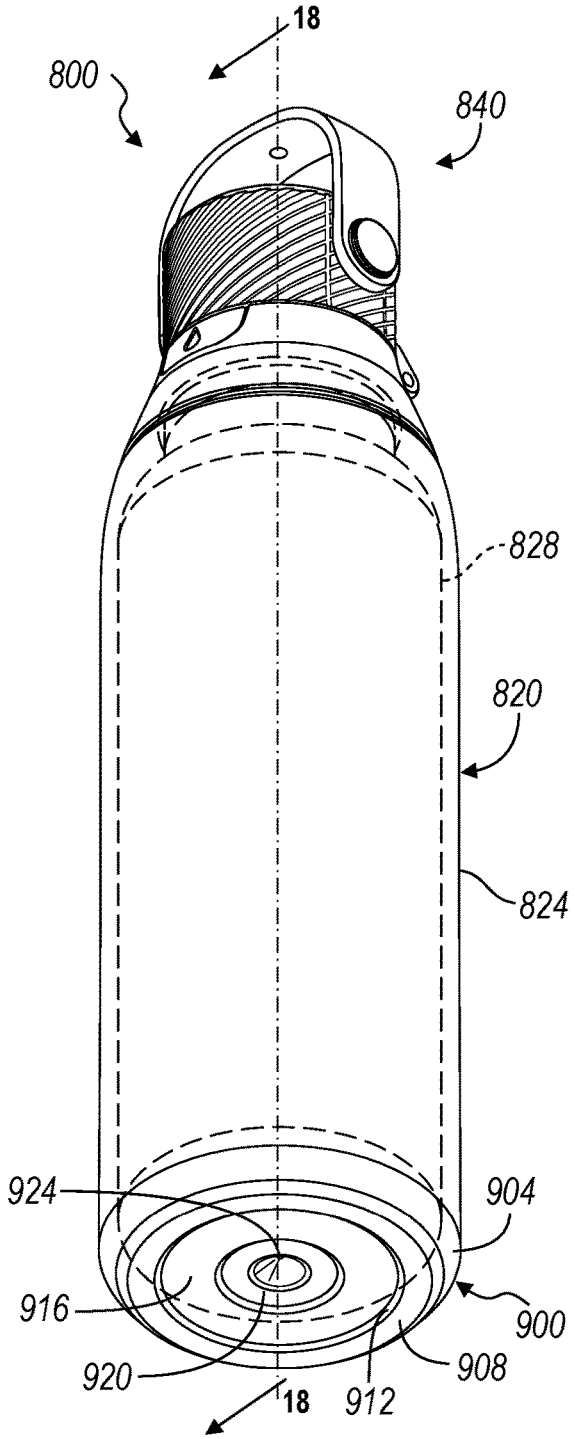
Figure 15:
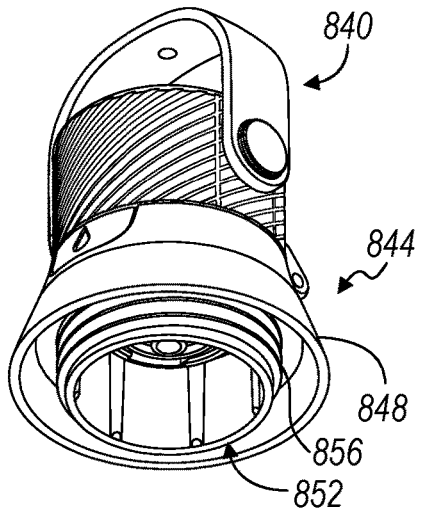
Figure 16:
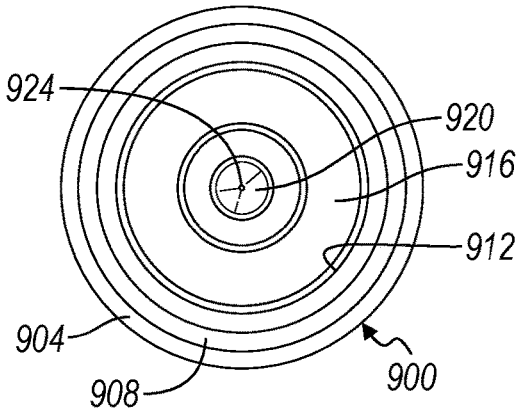
Figure 17:
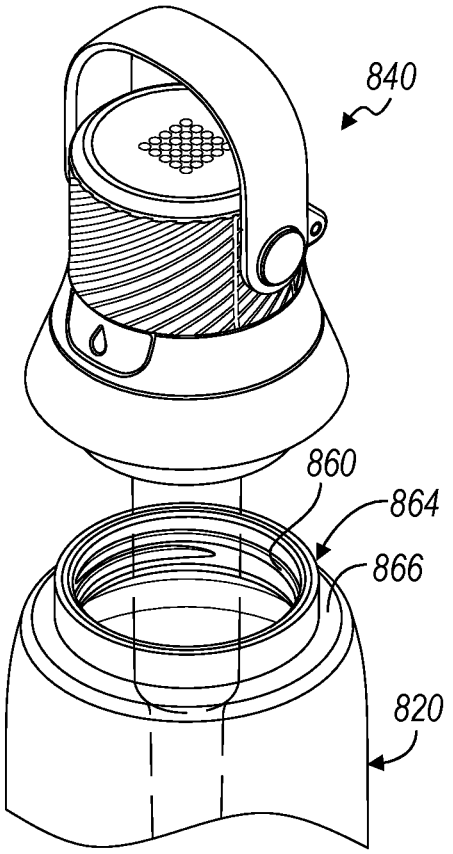
Figure 18:
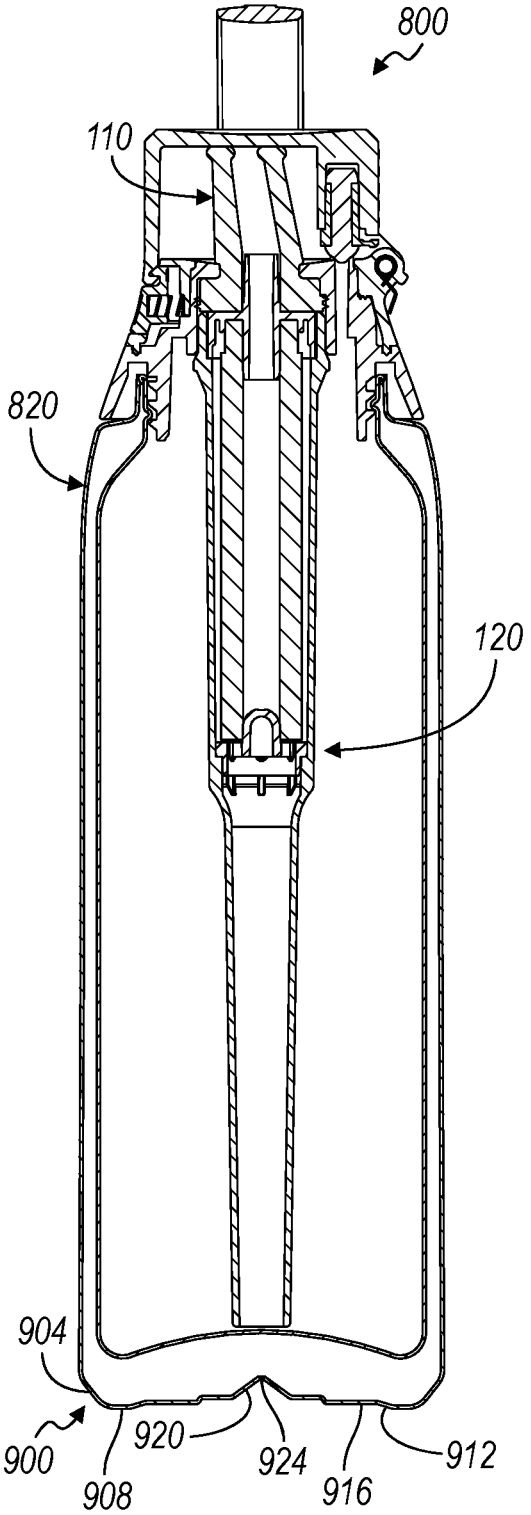

FIG. 11A' is a detail interior view of the lid of FIG. 11A;

FIG. 11B is a detail cross sectional view of the lid when in a partially open/closed position taken along line 11-11 in FIG. 1;

FIG. 11C is a detail cross sectional view of the lid when in a first open position taken along line 11-11 in FIG. 1;

FIG. 11C' is a cross sectional view of a mouthpiece in an uncompressed state, according to various embodiments;

FIG. 11D is a detail cross sectional view of the lid when in a second/full open position taken along line 11-11 in FIG. 1;

FIG. 12A is a cross-sectional view of the straw assembly taken along line 12-12 in FIG. 9;

FIG. 12B is a detail cross-section view take from circle 12B in FIG. 12A;

FIG. 12C is a detail cross-section view take from circle 12C in FIG. 12A;

FIG. 12D is a detail cross-section view take from circle 12D in FIG. 12A;

FIG. 13A is an exploded bottom perspective view of the lid and handle assembly;

FIG. 13B is a partial view of the lid and handle assembly;

FIG. 13C is a cross-section view of the lid and handle assembly with the handle in a first position taken along line 13-13 in FIG. 2;

FIG. 13D is a detail cross-section view of the lid and handle taken along line 13-13 in FIG. 2;

FIG. 14 is a bottom perspective view of a container similar to the container of FIG. 1 having a similar front elevation, right side elevation, left side elevation, back elevation, and top perspective views, according various embodiments;

FIG. 15 is a bottom perspective view of a closure assembly, according to various embodiments;

FIG. 16 is a bottom plan view of the container of FIG. 14;

FIG. 17 is a partial exploded view of the top closure assembly from the container of FIG. 14; and FIG. 18 is a cross-sectional view of the container of FIG. 14 taken along line 18-18 in FIG. 14.

Corresponding reference numerals indicate corresponding parts throughout the several views of the drawings.

DETAILED DESCRIPTION

Example embodiments will now be described more fully with reference to the accompanying drawings.

With reference to FIGS. 1 through 8, a container assembly 20 is illustrated. The container assembly 20 generally includes a container 24 and a closure assembly 26. As discussed further herein the closure assembly 26 may include a handle 30, a lid 34, and a lid or closure base portion 38. The closure assembly 26 may engage the container 24 via or through the base 38, as discussed further herein.

The container 24, with further reference to FIG. 9, includes a first end 42, which also may be referred to as a bottom end 42, and a top or second end 46. Near or at the top end 46 may be an engagement or closure engagement feature or wall 50. The closure engagement 50 may include an externally threaded wall 52 that includes one or more threads 54. The closure wall 52 may extend from a flat surface or wall 56 near or at the top end 46. As discussed further herein, the base 38 may include an internal thread 87 (FIG. 11B) that engages the external thread 54 of the engagement wall 52.

The container 24 further includes an external wall or surface 60 that extends from the bottom end 42 to the top end 46. The wall 60 may be formed as a single piece, such as in a single extrusion, molding, or forging. In various embodiments, the container 24 may be formed of a thermoplastic or other appropriate polymer material. A container 820 (FIG. 14) may include a container formed of a metal, such as a double wall structure. In various embodiments, the container 24 may include a single wall structure where the wall 60 has an external surface and an internal surface where the internal surface defines the internal volume 25 of the container 24. Further, the bottom 42 and the top 46 may be formed of separate members that are connected to the wall 60 and/or may be formed as a single piece with the wall 60, as mentioned above, and as generally understood in the art.

Figure 8:
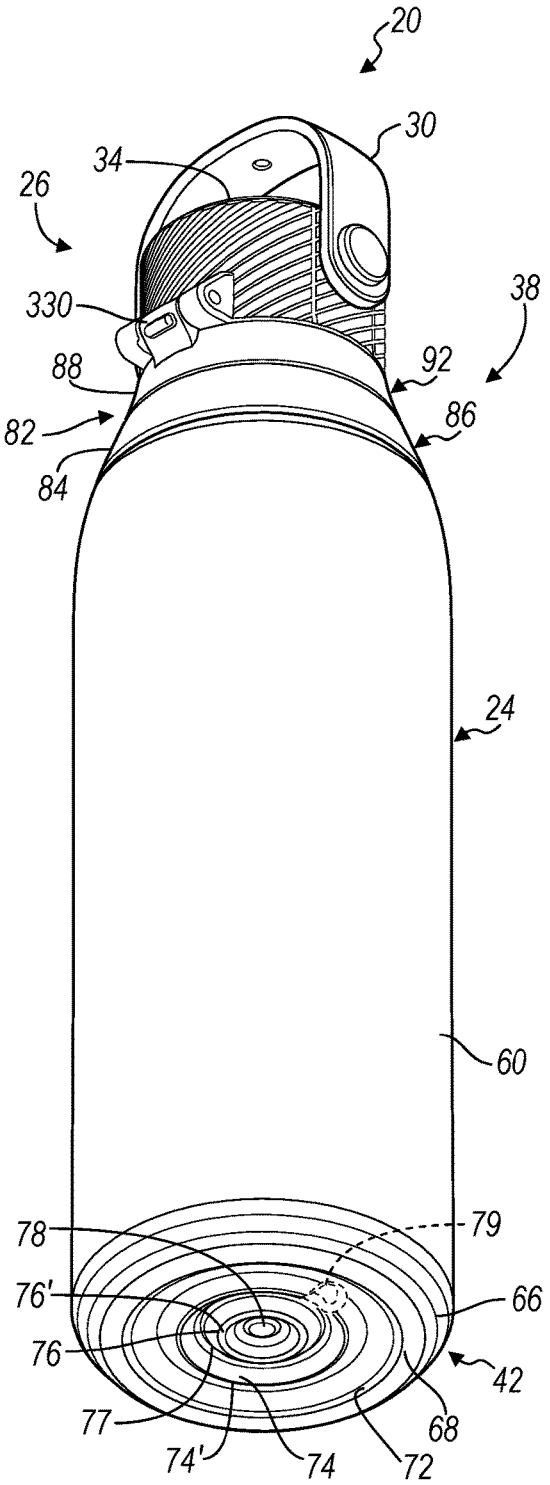
FIG. 8 is a bottom perspective view of the container of FIG. 1.

The bottom 42 may include various features, such as various or plurality of ridges including a first ridge or portion 68, a secondary ridge 74, and a tertiary or third ridge 76. Each of the ridges 68, 74, 76 may have respective raised walls or walls that ascend from a bottom surface 77 which may be at the same level or planar with the depression 78, or at a different level therefrom. The ridges may be formed as concentric circular or annular portions on the bottom surface of the container 24. It is understood that the respective wall surfaces 74', 76' may be sloped, angular, or the like. As illustrated in FIG. 8, however, the respective wall 74', 76' may generally be angular or conical to the respective edges 74, 76. The depression 78 may be a central depression at or near a center of the bottom or base 42. In various embodiments a mold release depression or portion 79 may also be formed in the bottom 42 but is not necessary and therefore may not be present.

Generally the container 24 may have a substantially cylindrical wall that is smooth and has a generally or substantially straight outer wall in cross-section that extends from the bottom 42 to near the top 46. The closure assembly 26, however, including the base 38 may form a tapered or angled edge or surface 82. The closure system 26 may be made of selected materials, with pieces that may be formed separately, including formed of Acrylonitrile butadiene styrene (ABS).

The surface 82 may be formed or defined by the base 38, such as in a first base portion 86 having a first surface portion 84 and a second surface 88 of a second base portion 92. The first base portion 86 and a second base portion 92 may be interconnected, as discussed further herein. The base 38 may be formed to have a truncated cone shape and configuration. Further the internal threads 87 may engage the external thread 54, discussed above, may be defined by only one of the two base members 86, 92, such as an internal surface of the first base portion or member 86. Also, as discussed further herein, the closure assembly 26 may include a trigger or operational button 96 that may be operated by a user to open or close the cap 34 relative to the base assembly 38.

With particular reference to FIG. 9 and continuing reference to FIGS. 1 through 8, the container assembly 20 includes the closure system 26 which may include a mouthpiece 110 that may be engaged by a mouth of a user, such as being placed in a mouth and a user enclosing lips around the mouthpiece 110 to draw material from within the container 24 through a withdraw tube 120. The withdraw tube 120, also referred to as a straw 120, generally extends along an axis 530 (FIGS. 9 and 11A). The straw 120 may further include various portions such as a distal portion 124 and a proximal portion 126. The straw 120, including the proximal portion 124 and the distal portion 126 may be formed as one piece. The distal portion 124 may have a terminal or distal end 128. During a manufacturing process or production process the proximal portion 126 and the distal portion 124 may be made as a single extrusion or molding. The single piece may reduce or eliminate openings and enhance suction and withdrawal through the straw 120 during use. The distal portion 124 may be positioned within the volume 25 and the end 128 near or adjacent an internal surface of the bottom 42 of the container 24.

The distal portion 124 may include a first diameter 132 and the proximal portion 126 may include a second diameter 134. The distal diameter 132 may be less than the proximal diameter 134. The difference in diameter between the distal portion 124 and the proximal portion 126 may form a ledge or shelf 136 within in the straw 120. Positioned on or adjacent to the ledge or shoulder 136 may be a boss or positioning member 140. The boss member 140 may include an outer edge 144 that may have one or more risers or ribs 148. The boss member 140 may be formed as a separate member that is configured to be inserted into the proximal portion 126 and near the ledge 136. Sonic welding or other fusion techniques may be used to fuse or weld the boss member 140 to the straw 120, such as to an interior wall surface of the proximal portion 126. It is understood that other fixation mechanisms, such as an adhesive, or the like may be used to fix the boss member 140 within the proximal portion 126. Sonic welding may use the ribs or risers 148 to weld or melt to the interior surface of the proximal portion 126 to fix the boss member 140 within the proximal portion 126.

The boss member 140 may include a passage or plurality of passages 152 that may, if a plurality of passages are present, be separated by one or more rib member or radial spokes 156. Extending from the spokes 156 may be a projection or boss (e.g. hemispherical) portion 160. The boss portion 160 may be used to engage and center a filter member 170 within the proximal portion 126. The filter member 170 may be a block filter, such as a block carbon filter, textile material, impregnated material, etc.

The filter member 170, therefore, may be formed of a porous material that filters fluid as it passes through the filter member 170. The filter 170 may be replaceable and removable. The filter member 170 therefore includes an exterior surface 174 and an interior passage 178. In various embodiments the fluid within the container 24 may be drawn through the straw 120, such as by a user sucking on the mouthpiece 110, such that fluid flows up the straw member 120, generally in the direction of arrow 182 and through the passage 152. As the water or fluid passes through the passage 152 it may engage a distal end of the filter member 170 and/or the outer surface 174 of the filter member 170, generally in the direction of arrow 186. As suction continues to be drawn, the fluid may pass through the filter member 170 and through the central passage 178. The fluid then may pass through a proximal boss or holding member 190. The proximal holding member 190 includes a filter holding portion 194 which may engage a top or upper surface 196 of the filter member 170. In various embodiments a top portion 196 of the filter member 170 may have an external geometry, such as a cylindrical surface, that is received within the filter engaging portion 194.

The proximal filter holding portion 190 further includes a proximal passage or projection 200 that includes or forms a central passage 204 through which the suction is drawn by the user. The filter holding member 190 may be engaged to the mouthpiece 110 such that suction drawn through the mouthpiece 110, such as through a central passage 112 formed by an outer wall 214 of the mouthpiece 110, also causes suction to be formed through the central passage 204 of the filter holding member 190. In various embodiments, the mouthpiece 110 includes a lower flange or engaging portion 218 that sealingly engages, e.g. a top surface or around an outer surface of the filter holding portion 194, such as an outer surface 222, to seal the mouthpiece 110 to the filter holding member 190. The mouthpiece 110 sealing to the filter holding member 190 allows suction through the mouthpiece 110 to be drawn through the filter holding portion 190. Therefore, a user may engage the mouthpiece 110 to draw fluid through the straw member 120, and through the filter portion 170 to the mouth of the user through the mouthpiece 110.

The mouthpiece 110, including the mouth engaging portion 214 and the flange receiving portion 218, may be formed as a single member. For example, the mouthpiece 110 may be formed in a molding process that molds the entire construct of the mouthpiece 110 as a single piece. It is further understood, however, that the mouthpiece 110 may be formed of separate pieces that are fixed together, such as with adhesives, welding, or the like. Nevertheless, the mouthpiece 110 may be formed of a single or multiple materials. In various embodiments, the mouthpiece 110 is formed as a single material of silicone rubber, natural rubber, pure silicone, latex, or other appropriate biocompatible and/or compressible materials that are bendable, resilient, etc.

The mouthpiece 110, for example, may be formed of a selected material, such as silicone rubber, having a Shore A hardness of about 20 to about 60, further including a Shore A hardness of about 30 to about 50, further including a Shore A hardness of about 35 to about 45, and further including a Shore A hardness of about 40. As discussed further herein, the mouthpiece 110 may be engageable by a user to form a vacuum through the straw 120 and through the mouthpiece 110 to withdraw fluid from within the container 24. The mouthpiece 110, therefore, further is formed to include a stiffness to maintain a shape or configuration to allow for engagement by a user and to draw a vacuum through the mouthpiece 110 without collapsing the mouthpiece 110 when drawing liquid or other selected material through the straw 120 and the filter member 170 through the mouthpiece 110. In addition, the mouthpiece 110 forms a seal to the material within the container 24 by engagement with the closure assembly 26, such as the lid 34. Thus, the mouthpiece may, therefore, be formed of a compliant or compressible material to engage various portions of the closure mechanism 26, such as the cap 34.

The base assembly 38, as illustrated in FIG. 9, may be formed of two members including the first member 86 and the second member 92, as discussed above. Each of the two members 86, 92 may be formed as a single member, or separate members as discussed above. The first and second members 86, 92 may be connected together such as with a snap fit, adhesive, welding, or the like to interconnect the first and second members 86, 92. Further a washer or sealing member material (e.g. pliable overmolding, etc.) may be positioned between the first and second members 86, 92 to assist in maintaining a fluid (e.g. water) tight seal between the two members 86, 92 of the base 38. A washer or gasket 230 may be provided within the base 38 to engage the container 24 to assist in sealing and leak prevention around the base 38 and the container 24.

The button or release 96 may be positioned relative to the base 38 and movable relative thereto. As illustrated, the first base member 86 may include one or more side rails or tracks 234, 236. The second member 92 may further include one or more rails or tracks which may be formed as depressions, such as a depression 240. The button 96 may include engaging or track portions, such as a projection 244 to engage the depression 240 of the second member 92. The button 96 may further include projections or other portions, such as edge 248 to ride along the rails 234, 236 of the first member 86. The button 96 may further include one or more stop or holding portions, such as a stop 252, which engages a ledge or stop portion 254 of the second member 92.

As discussed herein, the button 96 may be used to release and allow the lid 34 to open, such as automatically to one or more positions. The button 96 may be held in a locked or engaging position by a biasing or holding spring 260 that is compressed or held between an internal wall 264 of the second member 92 and a back or contact wall 268 of the button 96. Accordingly, as discussed further herein, the button 96 may be moved relative to the base assembly 38, such as by a user in a selected and controlled manner via interaction of portions of the button 96, as discussed above, along with rails or tracks of the base assembly 38. The spring 260 may biases the button 96 in a selected position, as discussed further herein.

The base assembly 38 may further include a vent hole or passage 272 that is formed or defined by a wall or structure 276 of the first member 86. The wall 276 may pass through an opening or passage 280 of the second member 92. Accordingly, when the base assembly 38 is assembled, such as the first member 86 to the second member 92, the wall or structure 276 may pass through the passage 280 such that the vent hole 272 is open to an external environment or to an environment covered by the cap 34. The vent hole 272 may be formed as a bore or passage that passes through the first member 86 to the interior of the container 24. The vent hole 272 may be formed with no interior or included valve portion. As discussed herein, the vent hole 276 may vent the interior of the container 24 as fluid is withdrawn from the interior of the container 24 through the straw member 120.

The vent hole 272 may be sealed by a seal having a valve portion or member 290. The valve member 290 may have a valve or sealing portion 294 that engages the structure 276, such as an upper or sealing surface or valve seat 296 with the sealing portion 294. The valve member 290 may be held in a valve member or portion 300 that is fixed within the cap 34 such as with a mechanical connection (e.g. snap connection), adhesive, or the like. The valve member 290 may include an elongated shaft or holding portion 304 that is held within a passage 306 of the valve holding member 300. A stop or projection portion 308 may hold the valve or sealing member 290 within the valve holding member 300. When the lid 34 is in a closed position, as discussed herein, the sealing portion 294 may seal against the seat 296 to seal the vent hole 272 when the lid 34 is closed.

Figure 10:
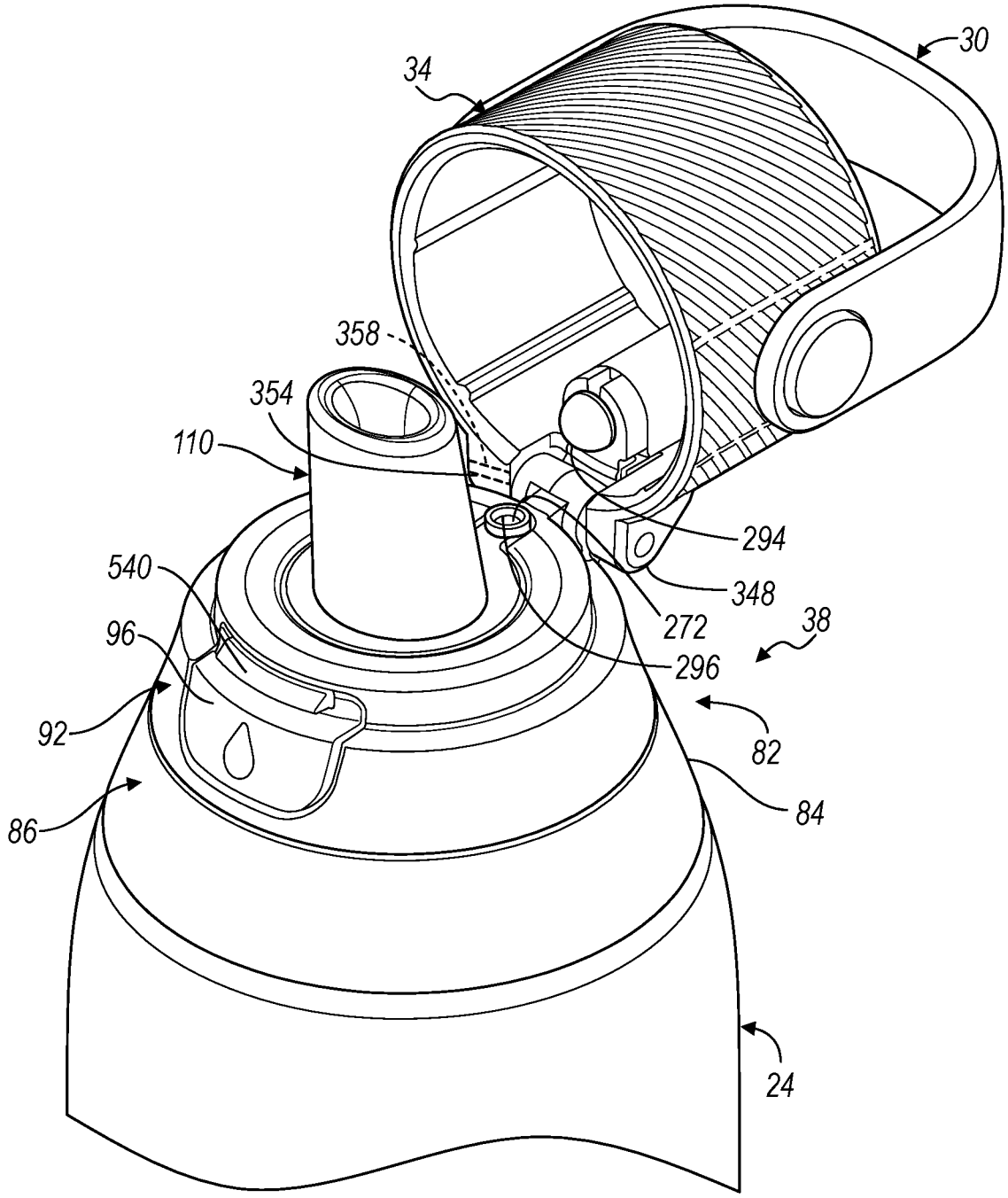
FIG. 10 is a top detail perspective view of the container of FIG. 1 with the lid open.

The lid 34 is movably connected to the base assembly 38, such as the second member 92 with a hinge assembly 330. With continuing reference to FIG. 9 and additional reference to FIG. 10, the hinge assembly 330 includes a hinge rod or pin 334 that passes through a base passage 338 formed through a passage wall 340 of the second member 92. The hinge pin 334 also passes through lid passages that may be formed through bosses or projections, such as a lid projection 348. A lid passage 352 may be formed through the boss 348 to engage the hinge pin 334. It is understood that the lid 34 may include a plurality of bosses, such as the first boss 348 and a second boss 354. The second boss 354 may also form or define a passage 358 for the hinge pin 334 to pass there through. Accordingly, the hinge pin 334 may pass through the passages 358, 338, and 352 to hingedly interconnect the lid 34 with the base assembly 38, such as the second member 92. The lid 34 may then be rotated relative to the second member 92 via the hinge pin 334.

The hinge assembly 330 may further include a holding or biasing spring 360. The biasing spring 360 may be positioned within the hinge assembly 330, such as around the hinge pin 334 and contacting the lid 34 and the second member 92. The spring 360 may then bias or assist in holding the lid 34 in a selected position, such as at least a first open position, relative to the base 38.

The container assembly 20 may exemplary further include the handle 30. The handle 30 may include an elongated member or portion 380 that extends in an arch or curved configuration from a first end 384 to a second end 386. The handle 30 may engage the lid 34 in a movable manner such that the handle 30 may be moved relative to the lid 34 and/or the mouthpiece 110 during use and operation of the container assembly 20. In various embodiments, for example, the lid 34 may include handle engaging portions, such as a projection 390, 392 to engage a depression or hole or bore 394, 410 formed in the handle member 380, such as near an end, such as the ends 384, 386. The projection 390, 392 may pass through the bore 394, 410 to a selected depth. The bore or hole 394, 410 may be capped or closed by a cap 396, 414 that may further include a projection or engaging portion 398 to engage a receiving or holding bore 402 within the projection 390. Similarly, the cap 34 may include a projection assembly opposite the first projection assembly 390 to engage the hole 394 while the first end 384 may include a hole 410 to engage or receive the projection 390 and also include a cap 414 to engage the hole or bore 402 and the projection 390.

The handle assembly 30, including the handle member 380, may be formed of a deflectable or conformable material. For example, the handle member 380 may be formed of a polymer, such as a semi-ridged plastic, such that it may be deformed to move over the projection 390 and the respective opposite projection 392. Accordingly, the handle 380 may be spread apart at the respective ends 384, 386 relative to one another to pass over the respective projections 390, 392. Upon releasing the handle member 380, the handle member 380 may return to a selected configuration or size and engage the projections 390, 392. The caps 396, 414 may be positioned over the bores 394, 410 to cover the projections 390, 392 and respective bores 394, 410.

The handle assembly 30 may further include an engagement or holding mechanism 450, 452 (FIG. 13A) near the respective ends 384, 386. The projection 450 may project to engage one or more detents and depressions formed near the respective projections 390, 392 of the lid 34. It is understood that only a single one of the projections 450 may be formed on the handle assembly 30 to engage depressions near only one of the projections 390, 392. The projection 450 may move between respective depressions relative to the projection 392 to hold the handle member 30 in selected pivoted positions relative to the lid 34. It is understood that the depressions may be formed into the lid 34 and/or into the projection 32 to engage the projection 450. The configuration may also be revered to include projections from the lid 34 to engage depressions in the handle member 380. The handle assembly 30 may be moved relative to the lid 34 by overcoming an interaction of the projection 450 with one or more depressions relative to the lid 34 such as through plastic deformation of the projection 450 and/or the depression. However the handle holding portion, such as the projection 450, may seat or engage a holding portion of the lid, such as a depression thereof, to hold the handle member 380 in a selected position relative to the lid 34.

With continuing reference to FIG. 1-FIG. 9 and additional reference to FIG. 10, FIG. 11A, FIG. 11B, FIG. 11C, FIG. 11C', and FIG. 11D, the operation of the lid 34 relative to the mouthpiece 110 of the closure assembly 26 of the container assembly 20 is illustrated. As discussed herein, the mouthpiece 110 may connect to the straw 120 to allow a user to withdraw material from the interior 25 of the container 24 through a passage 112 of the mouthpiece 110. For example, the user may suck on the mouthpiece 110 to cause suction through the passage 112 and the straw 120. Thus, when not in use the user may select to seal the mouthpiece 110. The lid 34 of the closure assembly 26 may be used to seal the mouthpiece 110, as discussed herein.

As discussed above, the closure assembly 26 includes various features and portions, such as the button 96, the lid 34, the sealing member or portion 290 that engages the seat of the structure 276 to seal the vent hold 272 that vents to an interior 25 of the container 24. Also, as discussed above, the straw assembly 120 extends into the interior 25 of the container 24 and is engaged to the mouthpiece 110 by the filter holding portion or member 190.

As illustrated in FIG. 11A the mouthpiece 110, including the sealing or engaging portion 218 may be held, such as compressed, within the base assembly 38 between the first member 82 and the second member 92. Accordingly, the interior 25 is sealed relative to the exterior of the container 24 at least around an outside of the mouthpiece 110 due to the position of the sealing portion 218 between the two members 86, 92 of the base 38. As discussed above, the filter engaging member 190 may further engage the filter 170 to hold the filter within the straw assembly 120, such as the proximal portion 126 and engage the mouthpiece 110.

As illustrated in FIG. 11A and FIG. 11A', the lid 34 is in a closed and sealed configuration. The lid 34 includes an interior top surface 470 that is substantially planar. The interior surface 470 may further be substantially smooth along an entire extent or area, at least between a first inner wall portion, which may also be referred to as a back wall 474 and a front wall 478. The top surface 470 may be substantially smooth between the wall portions 474, 478 and/or along an entire extent of the surface 470 to engage the mouthpiece 110 with the interior surface 470 that is a smooth surface. The mouthpiece 110 has the exterior wall 214 that extends from a top surface or extent 480 to a second member engaging region or surface 484.

The bottom engaging surface 484 of the mouthpiece 110 may include a ridge or depression that is received relative to the first member 86. The bottom engaging surface 484 may engage at a lip or engaging annular projection 486 of the first member 86. The engaging projection may assist in holding the mouthpiece 110 relative to the base assembly 38 during operation and use of the container assembly 20.

In the closed configuration of the lid 34 and the closure assembly 26, the top surface 470 of the lid 34 engages the top surface 480 of the mouthpiece 110 and may compress the mouthpiece 110. In compressing the mouthpiece 110, the sidewall 214 is compressed to a first height 490, as illustrated in FIG. 11A. The first or compressed height 490 may be about 10 millimeters (mm) to about 20 mm, including about 15 mm to about 25 mm, further including about 23 mm to about 27 mm, and further including about 25 mm. In the compressed or closed position the interior surface 470 may form the only seal with the edge 480 of the mouthpiece. In this way, the seal of the mouthpiece 110 may be formed only or substantially only with the lid 34 without closing or substantially closing (e.g. pinching) the passage 112 through the mouthpiece 110.

Further, the mouthpiece 110 having the passage 112 generally extends along an axis 114, as illustrated in FIG. 11C when the mouthpiece is not compressed. The axis 114 may form a compressed axis 114*c* and be moved, such as angled, towards the button 96 and away from the hinge portion 330 then compressed, as illustrated in FIG. 11A. In various embodiments, the mouthpiece 110 may move or translate toward the button 96 about 1 mm to about 3 mm, including about 1 mm. Thus, the compressed axis 114*c* may translate toward the button 96 from the uncompressed axis about 114 may be about 2 degrees to about 5 degrees, and further about 3 degrees. In neither position of the mouthpiece 110, however, is the passage 112 pinched closed. Further, even though the mouthpiece 110 may angle toward the button 96, such as for ease of use of the mouthpiece 110 by a user, the top 480 is generally parallel with the surface 522 when the mouthpiece is not compressed.

As illustrated in FIG. 11C, the mouthpiece 110 may be uncompressed when the lid 34 is in an open configuration 34*a*. In the uncompressed configuration the mouthpiece 110 may have the top surface 480, a second distance 494 from the bottom surface 484. The second distance 494 may be about 20 mm to about 30 mm, including about 25 mm to about 29 mm and further about 27 mm. The first or compressed dimension 490 may be a selected distance, such as about 1 mm to about 5 mm less than the second dimension 494. It is understood, however, that the first dimension 490 may also be about 2 mm to about 4 mm less than the second dimension or uncompressed dimension 494, and further may be about 2 mm to about 3 mm less than the uncompressed dimension 494. Further, the compressed dimension 490 may be about 2% to about 15% less, including about 7% to about 11% less, and further including about 9% less than the uncompressed dimension 494 of the mouthpiece 110. Thus, the bottle at the mouthpiece 110 may be sealed, such as from liquid exiting at the end of the mouthpiece, with a compression of only about 2% to about 10%, including about 8% to about 11%, and further about 9%.

Accordingly, when the top 34 is in the closed position, as illustrated in FIG. 11A, the top surface 470 engages the top surface 480 of the mouthpiece 110 and compresses the outer wall 214 of the mouthpiece 110, as illustrated in FIG. 11A. As further illustrated in FIG. 11A', the surface 470 is smooth and may include no ridges, bumps, or separate piece in addition to the lid 34. The surface 470, therefore, is substantially smooth and does not include an additional feature to engage the mouthpiece 110. The surface 470, by compressing the mouthpiece 110, as illustrated in FIG. 11A, causes the lid 34 to seal the mouthpiece 110 to ensure, including eliminate or substantially eliminating, fluid from leaving the container 24, such as from the interior 25, through the straw member 120 and the mouthpiece 110.

Further, the mouthpiece 110, as discussed further herein, may be angled away from the hinge assembly 330 when the lid 34 is in the closed configuration. The mouthpiece 110 may be compressed and bent or biased in a selected direction, such as away from the hinge assembly 330 and toward the button 96, then the lid is closed. Though the engagement and compression of the mouthpiece 110 alone may seal the mouthpiece 110 and the interior 25, the biasing at an angle may also assist in sealing the interior 25 of the container 24.

The lid 34, as discussed above, therefore, engages and compresses the mouthpiece 110 to the compressed dimension 490 that is generally perpendicular to the surface 522. The top 480 being parallel to the surface 522 may allow for ease of closing of the lid 34 and sealing the mouthpiece 110 such as through physical interaction and friction with the lid 34. Further, in engaging the mouthpiece 110, the lid 34 may move or angle the wall portion 214 away from the hinge assembly 330 and toward the button 96.

Initially, as illustrated in FIG. 11C, when not compressed a rear portion 214*r* of the mouthpiece 110 has an exterior surface that extends along a first line or axis 510. A front portion 214*f* has an exterior surface that extends along a second line or axis 514. Both of the lines 510, 514 are generally at an angle relative to a plane 522 that my generally be defined by a top surface 518 of the second portion 92. The first line 510 may form a first angle 524 relative to the plane 522. The first angle may be about 70 degrees to about 85 degrees, including about 75 degrees to about 78 degrees, and further be about 78 degrees. The second line 514 may form a second angle 528 relative to the plane 522. The second angle 524 may be about 80 degrees to about 90 degrees, and further about 85 degrees to about 89 degrees, and further be about 89 degrees. The respective angles, such as the first angle 524, may decrease about 2 degrees to about 5 degrees, and further about 3 degrees. The respective angles 524, 528 may allow for a more substantially flat or in line engagement of the surface 470 with the end 480 of the mouthpiece 110. Further, the respective angles 524, 528 may assist in the top 34 compressing or moving the mouthpiece generally in the direction of the button 96 when the lid 34 is moved in a closed direction.

As discussed above, and illustrated in FIG. 11C, the mouthpiece 110 may have a central passage 112 that may be substantially cylindrical between the front wall 214*f* and the rear wall 214*r*. The mouthpiece 110 may further engage the filter engaging portion 194, as illustrated in FIG. 11C, at or near the central passage 112. In various embodiments, as illustrated in FIG. 11C, the passage 112 may be substantially continuous and has a substantially similar or identical inner diameter between the ends of the mouthpiece 110.

In various embodiments, however, as illustrated in FIG. 11C', a mouthpiece 110' is illustrated. The mouthpiece 110' may have portions that are substantially similar to or identical to the portions discussed above, and may have numerals augmented with a "'". Accordingly, the mouthpiece 110' may include a front wall **214*f'* and a rear wall 214*r'* and a lower flange engaging portion 218'. The mouthpiece 110' further includes a passage 112' that may have an altering or diminishing inner diameter. The passage 112' is generally conical or tapers from the top or upper surface 480' toward the bottom flange engaging portion 218'**.

Further, the mouthpiece 110', such as at or near the flange portion 218', may include an enlarged or cylindrical region 576 that may have a substantially cylindrical wall 577 and an upper wall or ledge 581. The cylindrical region 576 may engage the filter engaging member 196 within the cylindrical region 576. The ledge 581 may engage a top surface or edge **194*a* of the filter engaging member 194. The ledge 581 allows the passage 112' to extend substantially uninterrupted through the filter engaging member 194 as the upper surface or edge 194*a* of the filter engaging member 194 engages or is "hidden" by the ledge 581. Thus, the passage 204 through the filter engaging member 194 is substantially continuous with the passage 112' of the mouthpiece 110'. The lid 34 may be closed by rotating the lid 34 or pivoting around the hinge assembly 330, generally in the direction of the arrow 532. When opening the lid 34, the lid 34 may be rotated around the hinge assembly 330 generally in the direction of the arrow 536. Accordingly, the lid 34, including the surface 470, may compress the mouthpiece 110 in a substantially axial direction, such as along a long axis 530 of the container 24 and/or straw 120 and also move or bend the mouthpiece 110 toward the button 96 and away from the hinge assembly 330**, as discussed above.

The lid 34 may be held closed by the button 96 engaging the lid 34, as illustrated in FIG. 11A. The button 96 may engage the lid 34 with a button locking portion 540 that may be formed as a finger or projection to engage a depression or rib 544 on an interior wall of the lid 34. The button 96 may be held or biased in the engaged position by the biasing or engagement spring 260. The spring 260, as discussed above, may be positioned between the wall 264 and the back wall of the button 268. The spring 260 may include a selected spring force to hold the button in the engaged position when not being depressed or pressed by a user. Accordingly, the button 96 may lock or hold the lid 34 relative to the base 38 when the button 96 is not depressed.

The button 96, however, may be pushed to overcome the spring force by being moved or pushed generally in the direction of the arrow 550, as illustrated in FIG. 11B. The force may be applied by a digit of a user, according to various embodiments, or other appropriate portion. In moving the button 96 against the spring 260, the button 96 may be guided or moved relative to the various rail and guide portions, such as the rails 234, 236 and the depressions 240 in the respective portions of the base 38. The movement moves the button engaging portion 540 away from or out of engagement with the lid engaging portion 544 and allows the lid 34 to become unlocked or disengaged from the button 96. Once disengaged, the lid 34 may move in the direction of arrow 536 around the hinge assembly 330. The lid 34 may move automatically, as discussed herein, to at least a first open position. This allows for ease and efficient access to the mouthpiece to withdrawal material from the container 24, such as water or other liquid.

The hinge assembly 330, as discussed above, includes the spring 360. The spring 360 may have a lid engaging end 560 and a base engaging end 564. The spring 360 may be included in the hinge assembly 330 such that the spring biases the lid 34 in the first open position **34*a*, as illustrated in FIG. 11C. Accordingly, movement of the button 96 generally in the direction of arrow 550 may allow the spring 360 to bias or move the lid generally in the direction of arrow 536 to the open position 34*a*, such as from the closed position illustrated in FIG. 11A and/or the partial closed position in FIG. 11B to the first open position illustrated in FIG. 11C. The spring 360 may allow for a substantially automatic or predefined movement of the lid 34 to the open position 34*a* as illustrated in FIG. 11C without further action by the user other than pushing or moving the button 96 to disengage the lid 34**.

The lid 34 may include a first edge or surface 570 that engages a projection 574 that extends from the passage portion 340 of the hinge assembly 330. The projection 574 may contact or engage the edge 570 of the lid 34 when the lid 34 is in the first open position **34*a*. The spring 360, as discussed above, biases the lid 34 to the open position, as illustrated in FIG. 11C, and the lid 34 stops in the open position 34*a* when the edge 570 engages the protrusion or projection 574**.

The lid 34 may be moved into a second or full open position **34*b*, as illustrated in FIG. 11D upon the application of a full opening force. The full opening force may overcome the friction and mechanical contact of the edge 570 against the projection 574. The full opening force is generally greater than that of the spring 360 to move the lid 34. For example, a user may move the lid past the projection 574 such as by deforming or compressing the edge 570 as it passes the projection 574**.

The edge 570, however, may further engage the projection 574, such as a bottom or second surface of the projection 578 to hold the lid 34 in the second open position **34*b*, as illustrated in FIG. 11D. Accordingly, the lid 34 may be moved to a plurality of open positions and be held in the open positions through various mechanisms. For example, as illustrated in FIG. 11C the lid 34 may be held in a first open position 34*a* by the spring force of the spring 360 and the edge 570 of the lid 34 engaging the projection 574. A second open position may be a greater or most open position by moving the lid 34 past the initial position. Moving the lid to the second or full opening position may be by deforming the edge 574 of the lid and/or the projection 574 to allow the edge 570 to engage a second or bottom portion of 578 of the projection 574. Both positions may be controlled and preselected positions of the lid 34**.

With continuing reference to FIG. 9 and turning reference to FIG. 12A, FIG. 12B, FIG. 12C, and FIG. 12D the straw 120, such as including the distal portion 124, may further include a grating or screen portion 600. The grating or screen portion 600 may include a selected porosity, such as having holes or throughbores that are between about 0.1 mm to about 3 mm, and further including about 1 mm to about 2 mm, and further including about 1 mm. It is understood, however, that an opening or passage 610 through the grating 600 need not be circular, but could be any appropriate shape. Further the passage 610 may include a plurality of passages in any appropriate shape or configuration at the distal end 128 of the straw 120. The grating 600 may be positioned or fixed to the distal end 128 of the straw 120 such as by a separate member that is adhered, welded, or the like to the distal end 128. It is understood, however, that the grating 600 may also be formed, such as with a molding, of the straw assembly 120.

In various embodiments, the grating 600 may provide or allow for the formation of a water tension at the grating 600 to reduce or eliminate water falling out of the straw assembly 120 due to gravity. Therefore, the straw 120 may be full of water, but it will not drain in a fast or in a premature manner through the grating 600 once the flow has stopped through the straw 120 and out the terminal end. Accordingly, the grating 600 may assist in reducing or minimizing emptying of the straw 120 upon removal of the straw 120 from the container 24, or other appropriate movements.

The straw member 120, as illustrated in FIG. 12A, can include features or portions (e.g. the distal portion 124) that extend from an internal bottom of the container 24 through to the mouthpiece 110. In addition, as discussed above, the boss portion 140 may be fit and/or fixed within the straw 120. As discussed above, the boss member 140 may include one or more risers 148 that may be sonically welded to form a sonic weld 148*w* as illustrated in FIG. 12C. The sonic weld 148*w* may fix the boss member 140 within the straw member 120 and allow for connection or holding the filter member 170 within the straw member 120.

The straw 120 at or near a proximal terminal end 126*a* may include a connection feature to engage and connect to the base 38. In various embodiments, the straw may include a projection or finger 616, and may further include two or more of the fingers 616. The fingers may engage one or more bayonet slots 618 formed in the first member 86 of the base 38. The straw 120 may be engaged and locked (e.g. removably fixed) to the base by moving the straw 120 in the direction of arrow 620 and then being rotated relative to the base 38 generally in the direction of arrow 622. Thus, the straw 120 may be held within the container 24 with a connection of the closure assembly 26.

With continuing reference to FIG. 9 and further reference to FIGS. 13A, 13B, 13C, and 13D, the container assembly 20 further includes the handle assembly 30, as discussed above. The handle assembly 30 is movable relative to the lid member 34. The handle member 380 may include the projection 450, as discussed above. A second projection 452 may also be formed at another end or a second end of the handle member 380 of the handle assembly 30. The projections 450, 452 may interact with one or more projections or detents, such as a detent 650 and a second detent 654, formed in a depression 660 near the projection 390 where the handle member 380 interconnects with the lid member 34.

The projection 452 may interact with the detent 650, 654 to positively hold and/or movably hold the handle member 380 in one or more positions relative to the lid 34. As illustrated in FIG. 13B the projection 452 may be positioned between the two detents 650, 652 to positively hold, such as in a movable manner, the handle 380 relative to the lid 34 in a first position, which may be an upright position. The handle member 380 may be moved relative to the lid 34 by applying a force to the handle member 380, such as generally in the direction of arrow 664 to overcome the holding force of the projection 452 over one of the detents, such as the detent 652 to move the handle member 380 to a second position 30'. The hole or depression area 660 may include a plurality of detents, or only the detents discussed above, to hold the handle member 380 in a plurality of positions. However, as illustrated in FIG. 13B, the hole or depression area 660 may only include the two detents 650, 652 to include a single main position and a plurality of other positions along the handle 380 to freely move once the projection 452 is moved from between the two detents 650, 652.

It is understood that the opposite side of the lid 34 may include similar configurations, as illustrated in FIG. 13C. The second side of the lid includes a second projection 672 and a depression or annular depression 676 which may include a plurality of detents, similar to the detents 650, 652. Accordingly, the handle member 380 may have two ends that positively engage with selected detents to move and/or hold the handle member 380 at selected positions relative to the lid 34. The illustration of the two detents 650, 652 is merely exemplary, and not intended to limit the number of detents possible.

As discussed above, the container 20 may include various embodiments, such as a container 800, as illustrated in FIG. 14, FIG. 15, FIG. 16, FIG. 17, and FIG. 18. The container 800 may include substantially similar or identical features to that discussed above save for those specifically discussed below. The container assembly 800 may include a container 820 that may be formed as a double wall container of a selected material, such as a stainless steel, titanium, or other appropriate material. Accordingly, the container 820 may include an exterior wall 824 and an interior wall 828. A closure assembly 840, similar to the closure assembly 26 discussed above, may also be included.

The closure assembly 840 may be substantially identical to the closure assembly 26 discussed above except that the closure assembly 840 includes a base portion 844 with a first member portion 848 that has an internal annular wall 852 that forms or defines an external thread 856. The external thread 856 may threadibly engage an internal thread 860 formed by a first wall or annular wall portion 964 at an end 866 of the container 820. Accordingly, the closure assembly 840 may engage the container 820 with an external thread 856 of the closure assembly 840 to an internal thread 860 of the container 820.

With additional reference to FIG. 16 and FIG. 18, the geometry and shape of the container 820 may be substantially identical to the container 24, discussed above, and therefore will not be repeated in detail here. However, the container 824 may include a base end 900 that includes a first chamfer or curved portion 904 to a first annular projection or base member 908. A wall, such as an internal wall 912 may extend from the projection 908 to a first depressed portion 916. Further, the base region 900 may further include a central depression such as an annular depression 920 which may include a conical portion or point 924. Accordingly, the container 824 may be substantially similar or identical to the container 24 discussed above, save for the variations discussed herein.

In light of the above, a container assembly may be provided that includes an internal tube or withdrawal system that allows a user to withdraw material from an internal portion or volume of the container, such as an internal volume. The withdrawal portion may also be referred to as a straw that allows the user to engage a mouthpiece and suck on the mouthpiece to form a vacuum within the straw. Material may then flow through the straw through the mouthpiece to the user. The straw may contain one or more filter portions to filter the material from the container as the material is withdrawn from the container. Further the container assembly may include a closure system that has a lid member that may be fixed or held relative to the closure system to engage the mouthpiece to sealingly close the interior of the container to an exterior environment. The lid may have a surface that engages the mouthpiece to form the sole or single seal relative to the mouthpiece to the interior of the container.

In various embodiments, the container assembly 20, 820 may be used for various purposes, such as containing a liquid (e.g. water, juice, energy drink, or the like) for access and withdrawal by a user. The user may fill the container 24, for example, by removing the closure system 26 including the straw member 120. As discussed above, the straw member 120 may engage the base 38 and therefore may be withdrawn with the closure assembly 26. The user may fill the container 24, including the internal volume 25, with a selected fluid, such as water. The user may ensure or select the filter 170 to allow for filtering of the water as the water is withdrawn from the container 24, or other fluid is withdrawn. Further the user may position a selected material within the straw member 120 for various purposes, such as flavoring the fluid placed within the container 24. Generally, the container 24 is filled through the top and not through the closure system 26, thus filtering would occur only upon withdrawal through the straw 120.

The user 20 may then place the closure assembly 26 onto a container 24 and seal the container 24 by closing the lid 34 onto the mouthpiece 110. As discussed above, the mouthpiece 110 may be sealed by contacting the upper surface 480 with the inner surface 470 of the lid 34. By so contacting the mouthpiece 110, the container 24, such as the internal volume 25, may be sealed from an external environment until the user opens the lid 34. The lid 34, alone therefore, may seal the interior of the container 24 from an external environment. If the vent passage 272 is included in the base 38, the sealing member 290 may also seal the vent passage 272, as discussed above.

When the user selects to withdraw the fluid from the container 24, the user may press the button 96 and the hinge assembly 330, including the spring member 360, may automatically open the lid 34 to the selected first open position. The user may then engage the mouthpiece 110 with the user's mouth to withdraw material from the container 24. Upon selection of the user, the user may select to move the lid 34 to the second open position by moving the lid past the projection 574, as discussed above. The lid 34 may then be held in the second position due to interaction of the edge 570 with the projection 574. As discussed above, both positions of the lid 34 may be predetermined and controlled by interaction with the hinge assembly 330.

Further the mouthpiece 110 may be sealed relative to the lid 34 without pinching the mouthpiece 110 and/or engaging the mouthpiece 110 with additional materials and/or portions. Therefore, the mouthpiece 110 may be long lasting and have a long life for efficiency of the container assembly 20 and/or reduction of the used material.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A system for containment and delivery of a material to a user, comprising:

a container having a wall and defining an internal volume, wherein the material may be contained within the container;

a mouthpiece held relative to an end of the container, wherein the mouthpiece includes a wall extending from a first end to a second end with a conduit through the mouthpiece from the first end to the second end, wherein the first end of the mouthpiece includes an uppermost surface at a distal end of the first end of the mouthpiece, and the mouthpiece has an uncompressed configuration in which it has a first longitudinal axis and a compressed configuration in which it has a second longitudinal axis, the second longitudinal axis being offset from the first longitudinal axis;

a straw member in fluid communication with the mouthpiece, the straw member having its own longitudinal axis, the straw member longitudinal axis being offset from both of the first longitudinal axis and the second longitudinal axis of the mouthpiece; and a lid having an end surface that is substantially smooth and moveable relative to the container at least between an open position and a closed position, wherein the end surface of the lid contacts at least the uppermost surface of the mouthpiece to form a seal between the uppermost surface of the mouthpiece and the end surface of the lid and to move the mouthpiece from its uncompressed configuration to its compressed configuration, and wherein, in the closed position, the end surface of the lid compresses the uppermost surface of the mouthpiece at least one millimeter to form the seal, and the end surface of the lid contacts only the uppermost surface of the mouthpiece.

2. The system of claim 1, wherein the lid moves the uppermost surface of the mouthpiece toward a side of the container when the lid is in a closed configuration relative to the mouthpiece.

3. The system of claim 1, wherein the end surface of the lid is smooth throughout the end surface of the lid.

4. The system of claim 3, wherein the end surface is an internal top surface of the lid.

5. The system of claim 1, further comprising:

a hinge assembly including a hinge member around which the lid is operable to move between the open position and the closed position, the hinge member including a hinge pin that extends through a first hinge bore formed by the lid and a second hinge bore fixed relative to the container.

6. The system of claim 1, wherein when the lid is in the closed position, the lid compresses the mouthpiece into a compressed configuration relative to a base, the compressed configuration being about 2% to about 10% smaller than an uncompressed configuration in which the mouthpiece is disposed when the lid is in the open position.

7. The system of claim 6, wherein the compressed configuration is smaller than the uncompressed configuration along a height dimension of the mouthpiece.

8. The system of claim 1, wherein the mouthpiece is formed of a compressible compliant material.

9. The system of claim 1, further comprising:

a base portion that is removably coupled to the container, wherein the lid is hingedly connected to the base portion and moves from the open position to the closed position relative to the base portion.

10. The system of claim 9, wherein the base portion includes a first member configured to directly engage the container and a second member configured to engage the first member.

11. The system of claim 9, further comprising a hinge assembly comprising:

a lid hinge bore;

a base hinge bore;

a spring configured to bias the lid relative to the base portion; and a hinge pin positioned within the lid hinge bore and the base hinge bore, wherein the spring is a coil spring coiled around the hinge pin.

12. The system of claim 1, further comprising:

a filter member configured to be held within the straw member.

13. The system of claim 12, further comprising:

a filter boss fixed within the straw member, wherein the straw member is a single member.

14. The system of claim 1, wherein the lid is held in at least a first position relative to the container by at least one of a spring member or a contact of the lid with a projection relative to the container.

15. The system of claim 1, further comprising:

a vent passage having a bore extending to an interior of the container; and a sealing member within the lid that is movable relative to the vent passage.

16. The system of claim 1, wherein the straw member is a single piece straw member, and the system further comprising:

a projection extending from an exterior surface of the single piece straw member; and a base member removably connectable to the container and defining a slot, wherein the projection engages the slot to hold the single piece straw member relative to the base member.

17. A system for containment and delivery of a material to a user, comprising:

a container having an outer wall and defining an internal volume, wherein the material may be contained within the container in the internal volume;

an internal withdrawal system positioned within the internal volume and extending between a first end of the container and a second end of the container, the internal withdrawal system includes a tube, the tube has a longitudinal axis;

a closure system having a base and a lid hingedly connected to the base, wherein the lid is moveable from an open position to a closed position and the lid has an internal end surface; and a mouthpiece held within the closure system, the mouthpiece including a wall that extends from a first end at the base to a second end, the wall forming a conduit through the mouthpiece from the first end to the second end, and the first end of the mouthpiece including an uppermost surface at a distal end of the first end of the mouthpiece, the mouthpiece has an uncompressed configuration in which it has a first longitudinal axis and a compressed configuration in which it has a second longitudinal axis, the second longitudinal axis being offset from the first longitudinal axis, each of the first longitudinal axis and the second longitudinal axis being offset from the tube longitudinal axis, wherein the internal end surface within the lid is substantially smooth and formed as one piece over an extent that contacts the uppermost surface of the mouthpiece, and wherein the internal end surface moves the uppermost surface of the mouthpiece toward the outer wall of the container when the lid moves from the open position to the closed position thereby forming a seal between the uppermost surface of the mouthpiece and the internal end surface of the lid and moving the mouthpiece from its uncompressed configuration to its compressed configuration, and the end surface of the lid contacts only the uppermost surface of the mouthpiece.

18. The system of claim 17, wherein:

tube has a first portion with a first cross-sectional dimension and a second section with a second cross-sectional dimension, wherein the first cross-sectional dimension is greater than the second cross-sectional dimension.

19. The system of claim 18, further comprising a filter holding member that is welded within the tube.

20. The system of claim 17, wherein the mouthpiece is formed of a compressible material, and the internal end surface of the lid compresses the uppermost surface of the mouthpiece at least one millimeter when the lid is in the closed position.

21. The system of claim 20, wherein the mouthpiece rebounds substantially all of the at least one millimeter when the lid moves from the closed position to the open position.

22. A method of sealing a system for containment and delivery of a material to a user, comprising:

forming an internal withdrawal system operable to be positioned within an internal volume of a container and extending from a first end to a second end, the internal withdrawal system having a first longitudinal axis;

forming a closure system by providing a base and hingedly connecting a lid to the base so that the lid is moveable from an open position to a closed position;

forming the lid as one piece with an internal end surface that is substantially smooth over an extent that is configured to contact a first end of a mouthpiece, the first end of the mouthpiece including an uppermost surface at a distal end of the first end of the mouthpiece, the mouthpiece having an uncompressed configuration in which it has a second longitudinal axis and a compressed configuration in which it has a third longitudinal axis, the third longitudinal axis being offset from the second longitudinal axis, and the first longitudinal axis is offset from both of the second longitudinal axis and the third longitudinal axis;

holding the mouthpiece within the closure system, wherein the mouthpiece includes a wall extending from a second end that is disposed at the base to the first end, wherein the wall forms a conduit through the mouthpiece from the first end to the second end; and configuring the internal end surface of the lid to engage at least the uppermost surface of the mouthpiece thereby forming a seal between the uppermost surface of the mouthpiece and the internal end surface of the lid, wherein when the lid is in the closed position, the internal end surface compresses the uppermost surface of the mouthpiece at least one millimeter to form the seal, and the end surface of the lid contacts only the uppermost surface of the mouthpiece.

23. The method of claim 22, further comprising:

connecting the closure system to the container having the internal volume.

24. The system of claim 1, wherein the mouthpiece has a passage that generally extends along an axis, and the axis is moved forwardly relative to the container when the end surface of the lid compresses the uppermost surface of the mouthpiece.

25. The system of claim 9, wherein the base portion has an upper surface that defines a plane, and the straw member longitudinal axis is perpendicular to the plane.

26. The system of claim 25, wherein the uppermost surface of the mouthpiece is parallel to the plane.

27. The system of claim 9, wherein the lid engages and compresses the mouthpiece in a direction that is generally perpendicular to the plane.

28. The system of claim 1, wherein the upper surface of the mouthpiece is not perpendicular to either of the first longitudinal axis or the second longitudinal axis of the mouthpiece.

29. The system of claim 17, wherein the base has an upper surface that defines a plane, the tube longitudinal axis is perpendicular to the plane, the uppermost surface of the mouthpiece is parallel to the plane, the uppermost surface of the mouthpiece is not perpendicular to either of the first longitudinal axis or the second longitudinal axis of the mouthpiece, and the lid engages and compresses the mouthpiece in a direction that is generally perpendicular to the plane.

* * * * *